US012312919B2

(12) United States Patent
Gupta et al.

(10) Patent No.: US 12,312,919 B2
(45) Date of Patent: May 27, 2025

(54) SEA FLOOR AUTOMATIC WELL INTERVENTION

(71) Applicant: Halliburton Energy Services, Inc., Houston, TX (US)

(72) Inventors: Sudhir Gupta, Houston, TX (US); Wei Zhang, Houston, TX (US); Michael Linley Fripp, Singapore (SG); Rodney Allen Marlow, Houston, TX (US); Charles Richard Thomas Hay, Houston, TX (US); Arabinda Misra, Singapore (SG); Francis Michael Heaney, Singapore (SG); Christopher Michael Jones, Houston, TX (US); Darren George Gascooke, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/423,036

(22) Filed: Jan. 25, 2024

(65) Prior Publication Data

US 2024/0344431 A1 Oct. 17, 2024

Related U.S. Application Data

(60) Provisional application No. 63/496,338, filed on Apr. 14, 2023.

(51) Int. Cl.
*E21B 47/12* (2012.01)
*E21B 19/22* (2006.01)
(Continued)

(52) U.S. Cl.
CPC ..... *E21B 43/013* (2013.01); *E21B 41/0007* (2013.01); *E21B 47/12* (2013.01)

(58) Field of Classification Search
None
See application file for complete search history.

(56) References Cited

U.S. PATENT DOCUMENTS 2,909,574 A 10/1959 Woodle
5,458,200 A 10/1995 Lagerlef et al.
(Continued)

OTHER PUBLICATIONS

International Search Report and Written Opinion for International Patent Application No. PCT/US2024/015591 dated Jun. 4, 2024. PDF file. 10 pages.

(Continued)

*Primary Examiner* — Matthew R Buck
*Assistant Examiner* — Douglas S Wood
(74) *Attorney, Agent, or Firm* — John Wustenberg; C. Tumey Law Group PLLC

(57) ABSTRACT

In general, in one aspect, embodiments relate to a method that includes assembling a downhole tool from a plurality of subassemblies with a robotic tool assembly disposed on a subsea tree at a sea-floor in a subsea environment. The method may also include introducing the downhole tool into a wellbore, traversing the wellbore with the downhole tool to reach one or more target depths, performing at least a wellbore operation with the downhole tool at the one or more target depths, and retrieving the downhole tool from the wellbore after performing the wellbore operation.

20 Claims, 11 Drawing Sheets

(51) Int. Cl.

| | |
|---|---|
| ***E21B 41/00*** | (2006.01) |
| ***E21B 41/04*** | (2006.01) |
| ***E21B 43/013*** | (2006.01) |

(56) References Cited

U.S. PATENT DOCUMENTS

| | | | | |
|---|---|---|---|---|
| 6,070,608 | A | 6/2000 | Pringle | |
| 6,343,651 | B1 | 2/2002 | Bixenman | |
| 6,405,798 | B1 | 6/2002 | Barrett et al. | |
| 6,799,633 | B2 | 10/2004 | McGregor | |
| 7,165,619 | B2 * | 1/2007 | Fox | E21B 19/146 166/77.2 |
| 7,303,010 | B2 | 12/2007 | de Guzman et al. | |
| 7,779,916 | B2 * | 8/2010 | Zemlak | E21B 19/002 166/344 |
| 8,006,765 | B2 * | 8/2011 | Richards | E21B 19/146 166/341 |
| 8,235,124 | B2 * | 8/2012 | Cuiper | E21B 19/002 166/368 |
| 9,587,477 | B2 | 3/2017 | Lafferty et al. | |
| 9,650,851 | B2 | 5/2017 | Whitsitt et al. | |
| 10,385,657 | B2 | 8/2019 | Nuryaningsih et al. | |
| 10,459,107 | B2 | 10/2019 | Pelletier et al. | |
| 10,612,370 | B2 | 4/2020 | Bouldin et al. | |
| 11,008,822 | B2 | 5/2021 | Fernandes et al. | |
| 11,047,189 | B2 | 6/2021 | Fernandes et al. | |
| 11,530,584 | B2 | 12/2022 | Fanini et al. | |
| 11,566,494 | B2 | 1/2023 | Greci et al. | |
| 2002/0040783 | A1 * | 4/2002 | Zimmerman | E21B 47/001 166/360 |
| 2005/0189115 | A1 * | 9/2005 | Rytlewski | E21B 47/00 166/344 |
| 2009/0159273 | A1 | 6/2009 | Guerrero | |
| 2011/0240303 | A1 | 10/2011 | Hallundbaek | |
| 2015/0116123 | A1 | 4/2015 | Gordon et al. | |
| 2017/0370173 | A1 * | 12/2017 | Gable | B63C 11/52 |
| 2020/0003024 | A1 * | 1/2020 | Dusterhoft | E21B 47/12 |
| 2022/0098939 | A1 * | 3/2022 | McCormick | E21B 17/085 |

OTHER PUBLICATIONS

Halliburton, Petrobras Wells of the Future Roadmaps, Dec. 8, 2022.

* cited by examiner

SEA FLOOR AUTOMATIC WELL INTERVENTION

CROSS-REFERENCE TO RELATED APPLICATIONS

The present application is a nonprovisional of provisional U.S. Patent Application No. 63/496,338 filed Apr. 14, 2023, the entire disclosure of which is incorporated herein by reference.

BACKGROUND

Borcholes drilled into subterranean formations may enable recovery of desirable fluids (e.g., hydrocarbons), or geological storage of other fluids (e.g., carbon dioxide), using a number of different techniques. Borcholes drilled on land and/or the sea-floor may rely on extensive infrastructure. Generally, operations and services are performed while tethered to infrastructure.

There is a need for un-tethered autonomous robots to execute well intervention services that do not need additional infrastructure like wireline/coil tubing winches, rigging equipment, ships/boats for deep sea wells or shutting off producing wells.

BRIEF DESCRIPTION OF THE DRAWINGS

These drawings illustrate certain aspects of some examples of the present disclosure and should not be used to limit or define the disclosure.

DETAILED DESCRIPTION

The present disclosure relates generally to a system and method for autonomous infrastructure that may operate and function apart and untethered from traditional infrastructure. For example, various subassemblies of different downhole tools may be disposed in storage silos that may be assembled and then run into a particular wellbore through an automated assembly. The automated assembly may be a robotic tool assembly that may rotate different subassemblies into an assembly area to assemble different tools, e.g., downhole tool, configured for the desired task. Once assembled, the downhole tool(s) may be run into the wellbore to perform the desired task. Subsequently, downhole tools may be recalled or retrieved (e.g., via wireline or tractor) and disassembled into their respective subassemblies or groups of modules and returned to their respective storage silos in the robotic tool assembly. Modules in need of replacement may be rotated into deployment silos configured to exchange subassemblies. Such autonomous infrastructure may quickly assemble a needed configuration while reducing the amount of infrastructure needed to run the downhole tool into a wellbore. A downhole tool formed by the robotic tool assembly may be, without limitation, a wireline tool, bottomhole assembly, untethered robot, or the like.

Figure 1A:
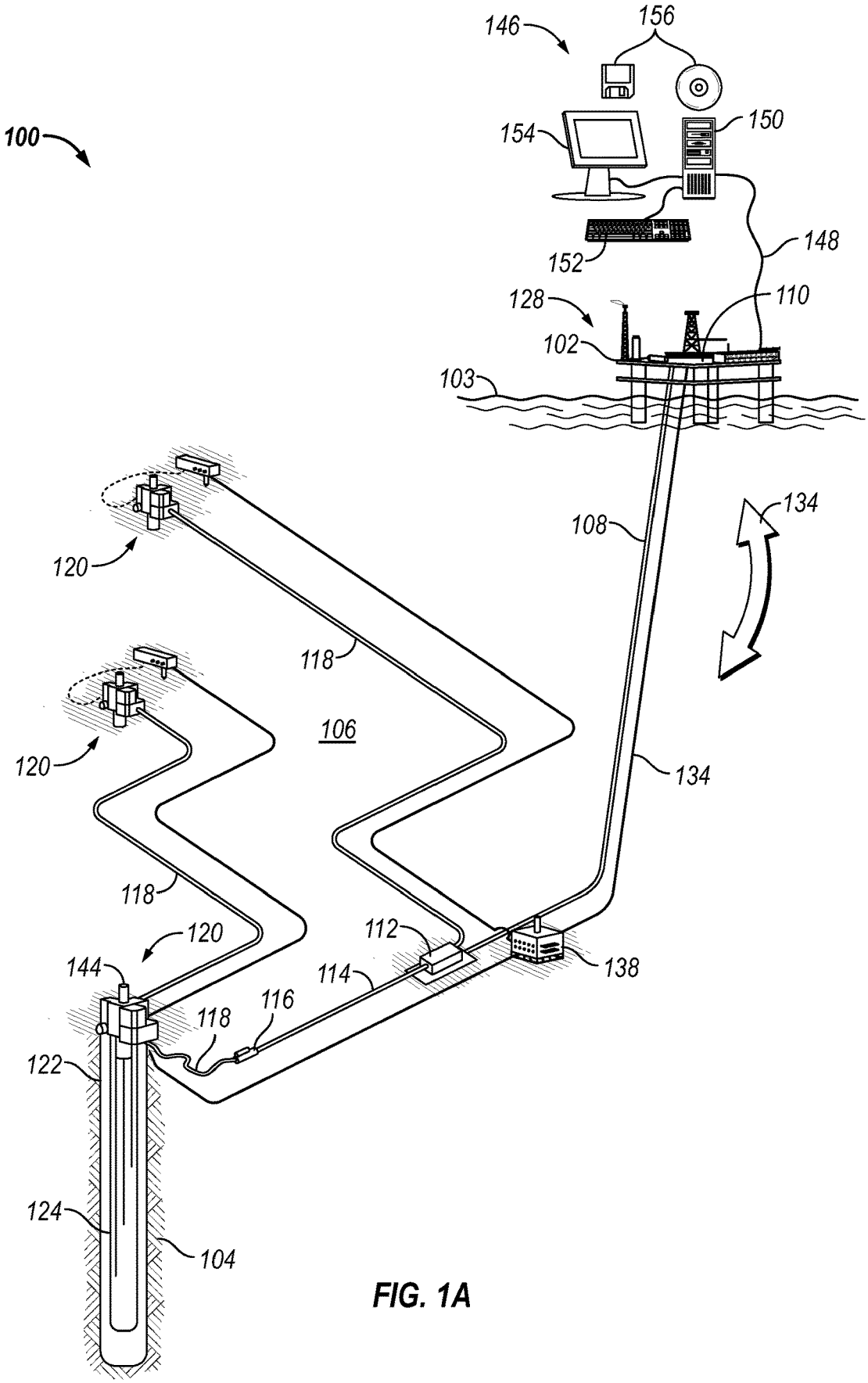
FIG. 1A illustrates a schematic diagram of an example of a well system in a subsea environment, in accordance with one or more embodiments of the present disclosure.
Figure 1B:
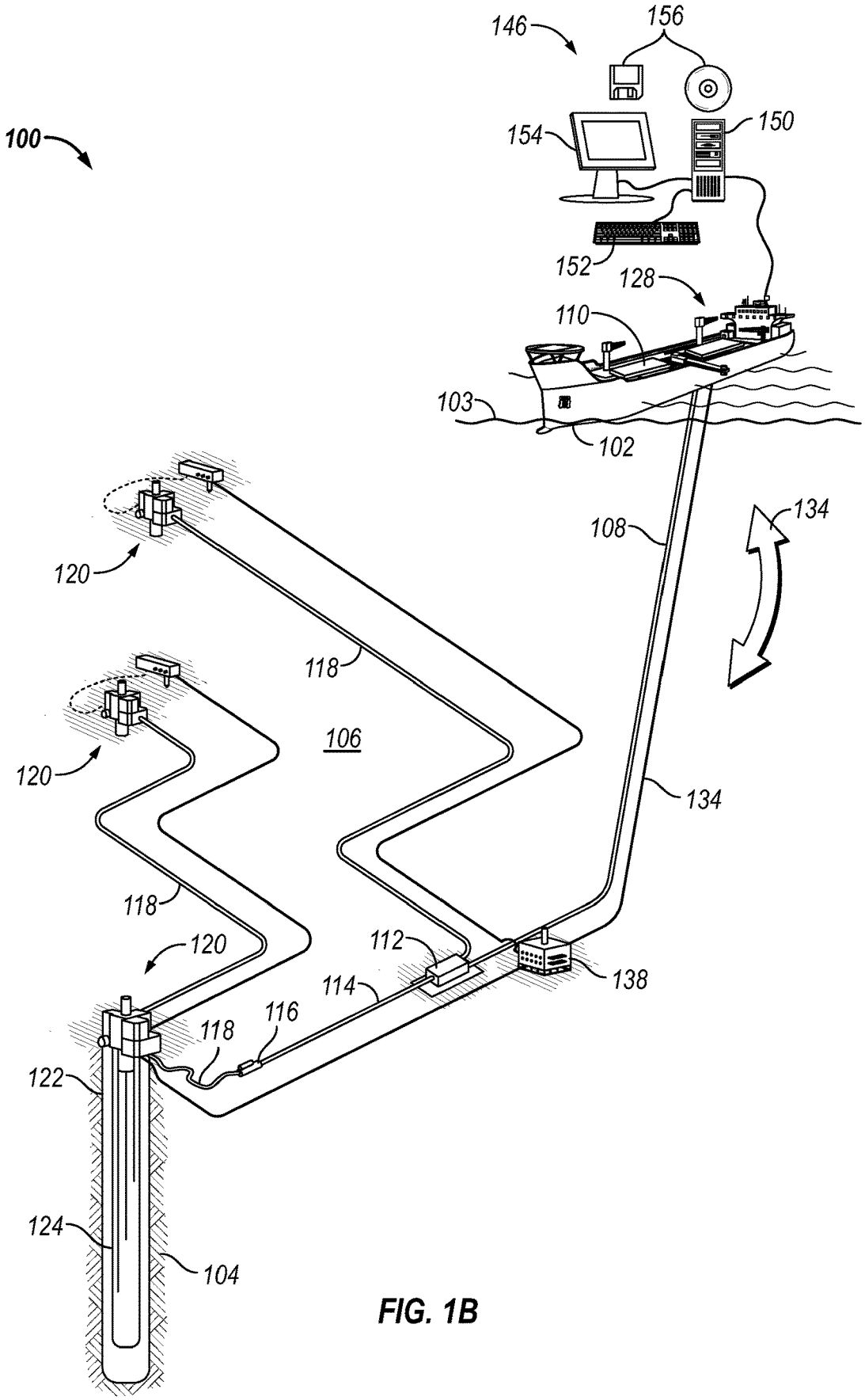
FIG. 1B illustrates a schematic diagram of an example of a well system in a subsea environment, in accordance with one or more embodiments of the present disclosure.

FIGS. 1A and 1B illustrate schematic diagrams of an example of a well system 100 that may employ the principles of the present disclosure. More particularly, well system 100 may comprise a floating vessel 102 centered over a subterranean hydrocarbon bearing formation 104 located below a sea-floor 106. As illustrated, floating vessel 102 is depicted as an offshore, semi-submersible oil and gas drilling platform, but could alternatively comprise any other type of floating vessel such as, but not limited to, a drill ship, a pipe-laying ship, a tension-leg platforms (TLPs), a spar platform, a production platform, a floating production, storage, and offloading (FPSO) vessel, a floating production unit (FPU), and/or the like. Additionally, and without loss of generality, the methods and systems described below may also be utilized for subsea tiebacks to a fixed offshore platform, an onshore facility, or a facility on an artificial island. Moreover, the systems and methods of the present disclosure are applicable to onshore reservoirs and related facilities. A subsea conduit or riser 108 extends from a deck 110 of floating vessel 102 to sea-floor 106 and may connect to a production manifold 112. As illustrated, static pipe 114 may run from production manifold 112 to a pipeline end termination 116. Flexible pipe 118 may attach a subsea tree 120 to pipeline end termination 116. In examples, flexible pipe 118 may traverse from production manifold 112 and connect directly to subsea tree 120. Additionally, flexible pipe 118 may connect one subsea tree 120 to another subsea tree 120, effectively tying one or more subsea trees 120 together and allowing for a single flexible pipe 118 to connect one or more subsea trees 120 to a single production manifold 112.

Subsea tree 120 may cap a wellbore 122 that has been drilled into formation 104. Within wellbore may be a completion system comprising of one or more tubulars 124 that are connected to subsea tree 120. During operations, formation fluids may be produced from formation 104, and flow through one or more tubulars 124 to subsea tree 120. As subsea tree 120 is attached to floating vessel 102, formation fluid may flow from subsea tree 120, through flexible pipe 118, pipeline end termination 116, static pipe 114, production manifold 112, and up through riser 108 to floating vessel 102 for processing, storage, and subsequent offloading or export.

With continued reference to FIGS. 1A and 1B, well system 100 may comprise a central controller unit (CCU) 128. CCU 128 may monitor wellbore 122 in real time. "Real-time" as used herein refers to a system, apparatus, or method in which a set of input data is processed and available for use within 100 milliseconds ("ms"). In further examples, the input data may be processed and available for use within 90 ms, within 80 ms, within 70 ms, within 60 ms, within 50 ms, within 40 ms, within 30 ms, within 20 ms, or any ranges therebetween. In some examples, real-time may relate to a human's sense of time rather than a machine's sense of time. For example, processing which results in a virtually immediate output, as perceived by a human, may be considered real-time processing. CCU 128 may comprise one or more information handling systems 146. Information handling system 146 may comprises any instrumentality or aggregate of instrumentalities operable to compute, estimate, classify, process, transmit, receive, retrieve, originate, switch, store, display, manifest, detect, record, reproduce, handle, or utilize any form of information, intelligence, or data for business, scientific, control, or other purposes. For example, an information handling system 146 may be a processing unit 150, a network storage device, or any other suitable device and may vary in size, shape, performance, functionality, and price. Information handling system 146 may comprise random access memory (RAM), one or more processing resources such as a central processing unit (CPU) or hardware or software control logic, ROM, and/or other types of nonvolatile memory. Additional components of the information handling system 146 may comprise one or more disk drives, one or more network ports for communication with external devices as well as an input device 152 (e.g., keyboard, mouse, etc.) and video display 154. Information handling system 146 may also comprise one or more buses operable to transmit communications between the various hardware components.

Alternatively, systems and methods of the present disclosure may be implemented, at least in part, with non-transitory computer-readable media 156. Non-transitory computer-readable media 156 may comprise any instrumentality or aggregation of instrumentalities that may retain data and/or instructions for a period of time. Non-transitory computer-readable media 156 may comprises, for example, storage media such as a direct access storage device (e.g., a hard disk drive or floppy disk drive), a sequential access storage device (e.g., a tape disk drive), compact disk, CD-ROM, DVD, RAM, ROM, electrically erasable programmable read-only memory (EEPROM), and/or flash memory; as well as communications media such as wires, optical fibers, microwaves, radio waves, and other electromagnetic and/or optical carriers; and/or any combination of the foregoing.

During monitoring operation, CCU 128 may determine if an intervention operation may be performed. In examples, an intervention operation may be valve shifting, brushing, bailing, milling or routine pressure balancing. In other examples, a user at surface 103, may send a command to perform the intervention operation to a sea bed server 138 from information handling system 146. This command may be sent via a telemetry mechanism 134 between surface and sea bed server 138. Telemetry mechanism 134 may comprise, for example, compression wave telemetry, a fiber optic cable, a radio signal, or any suitable signal, wired, or equivalent form of telemetry known in the art. Sea bed server 138 may request a robotic tool assembly 178, disposed on subsea tree 120, to assemble a downhole tool. As used herein, a "robotic tool assembly" refers to a system, disposed at the sea floor, which is capable of forming at least one downhole tool from a plurality of submodules. In general, robotic tool assembly 178 comprises moving parts which are configured to move the submodules during assembly and/or disassembly of the at least one downhole tool.

Figure 2:
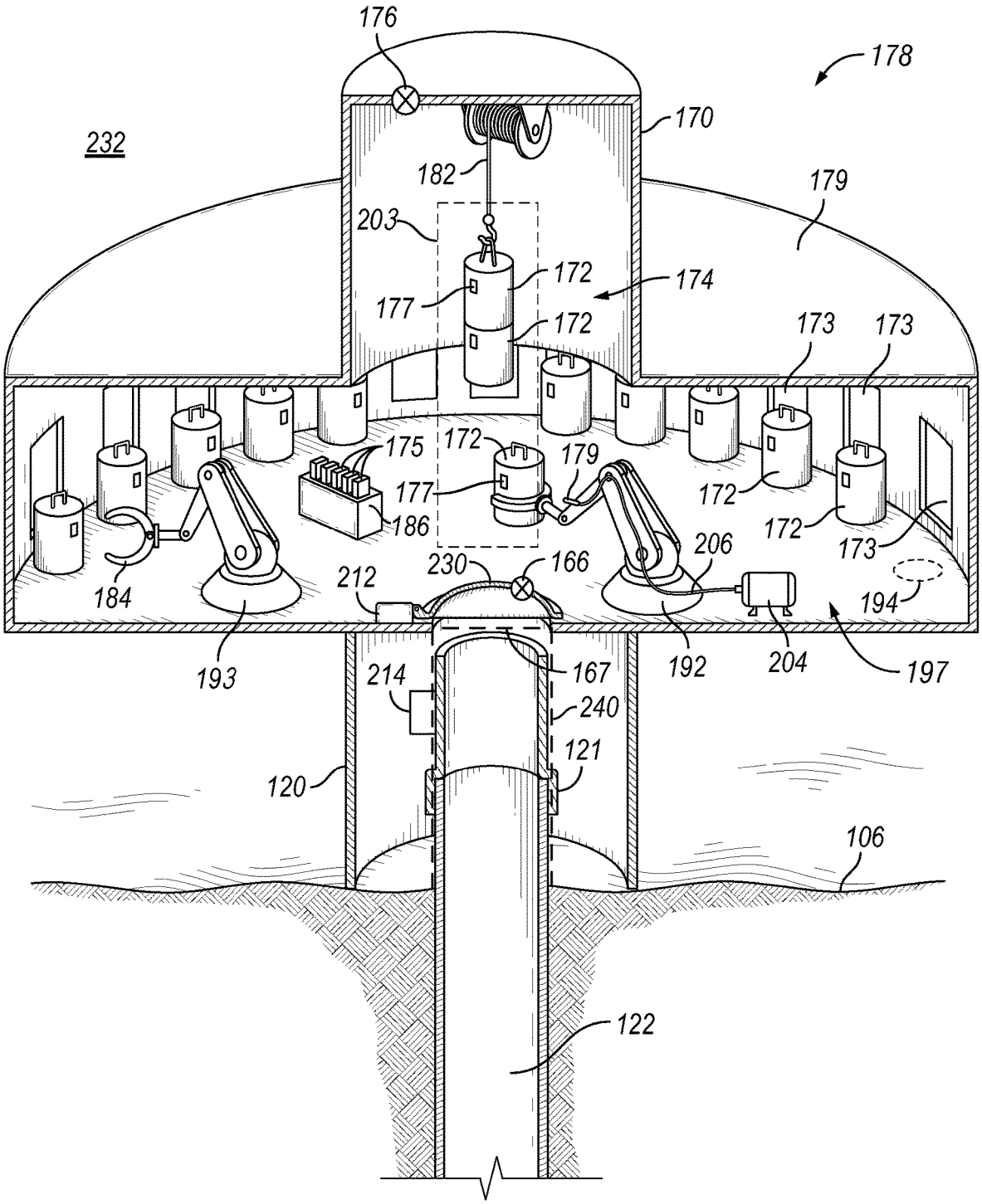
FIG. 2 illustrates a schematic diagram of an example of a subsea tree and a robotic tool assembly, in accordance with one or more embodiments of the present disclosure.

FIG. 2 illustrates a schematic diagram of a robotic tool assembly 178, which may be utilized to form a downhole tool 174. Robotic tool assembly generally comprises subsea housing 179 disposed on a subsea tree 120 and contains equipment for assembling and disassembling downhole tool 174. In this figure, such equipment comprises first and second robotic arms 192, 193, however may comprise alternative means for assembling or disassembling downhole tool 174 (e.g., pistons, rollers, conveyors, grippers, linear tracks, pulleys, etc.). In general, however, robotic tool assembly 178 is characterized as a "self-contained" system due to its ability to assemble and disassemble downhole tool 174 from a plurality of subassemblies 172 within an assembly space schematically shown at 203 that is disposed within an internal region 197 of a housing 179 of robotic tool assembly 178. In addition, robotic tool assembly 178 may be characterized as autonomous, in some examples. As used herein, "autonomous" in this context refers to operations for forming a downhole tool based on computer calculation. In other examples, robotic tool assembly 178 may be characterized as directed. As used herein, "directed" in this context refers to operations for forming a downhole tool based on input by a user. In other examples, robotic tool assembly 178 may be characterized as a hybrid, having both autonomous and directed components. Similarly, such may be characterized as automated, or else semi-automated. As used herein, "automated" refers to a process or subpart thereof which is performed entirely without any user input. In examples, robotic tool assembly 178 or one or more subcomponents thereof may be automated such that assembly and/or disassembly of a downhole tool is achieved entirely free, or essentially free, from human input. In some examples, a type or types of procedure common to all downhole tools which may be formed by robotic tool assembly 178 may be performed autonomously, while another type or types of procedure specific to a downhole tool may be directed by user input, in some examples.

Also visible in this figure are the various subassemblies 172 disposed at their respective storage locations 194. Subassemblies 172 are modules used to form any given downhole tool 174 of a plurality of types of downhole tools, for example, any of the well intervention, logging, or other downhole tools disclosed herein, which may be tethered or untethered. As used herein, "tethered" refers to a spooled connection between the surface (e.g., seabed or sea level) and a tool, and "untethered" refers to a lack of any spooled connection between the surface and a tool. For example, a tether may be a wireline, slickline, or cabled connection.

Storage locations 194 are schematically shown as a dotted circle to show their location within housing 179 but may comprise any suitable device or apparatus for compartmentalizing, storing, or otherwise housing subassemblies 172 at locations retrievable by the assembling/disassembling equipment of robotic tool assembly 178. Optionally, such storage locations 194 may be accessible from subsea environment 232, such as via slot(s) 173.

Slot(s) 173 may be open to subsea environment 232, or alternatively, may be configured to switch between scaled/unsealed configurations. In examples, this may involve one or more scaling devices, (e.g., sliding doors, hatch, etc.), which may allow robotic tool assembly 178 to seal off internal region 197 from subsea environment 232, such as in embodiments where it is desirable to pressurize internal region to a wellbore pressure prior to opening or closing well access 230. The purpose of slot(s) 173 is to allow a UAV (e.g., UAV 160 of FIG. 6) to resupply robotic tool assembly 178 with subassemblies 172, replacement batteries, etc., while minimizing the internal region's exposure to the subsea environment 232. In examples, each slot 173 may be configured to receive a single, or a plurality of, subassemblies 172. If a slot 173 is adapted to receive more than one subassembly 172, they may be the same type of subassembly 172, such as an anchor module, or a bailing module, etc.

In operation, robotic tool assembly 178 may identify and locate all subassemblies 172 that may form downhole tool 174. Prior to assembly, the different subassemblies 172 may be housed by robotic tool assembly 178, as mentioned. In examples, robotic tool assembly 178 may be equipped to retrieve subassemblies 172 from their respective storage locations 194 in order to make up the downhole tool 174 based on pre-determined instructions specific to a type of downhole tool 174. Storage locations 194 may comprise any suitable type of containment unit (e.g., silo, cubby, plain surface, compartment, dock, etc.) for holding one or more subassemblies 172. In examples, robotic tool assembly 178 may place all subassemblies 172 for a certain type of downhole tool in a selected order and stack each subassembly on top of each other within an assembly space 203 of robotic tool assembly 178. The assembly space 203 may comprise a direct well access (e.g., direct well access 202 of FIG. 3A) or an indirect well access (e.g., indirect well access 200 of FIG. 3A). As used herein, a "direct well access" refers to a space or region within subsea housing 179 directly above subsea tree 120 for accessing wellbore 122, whereas an "indirect well access" refers to a space or region within subsea housing 179 which is near or proximate to (e.g., adjacent), a direct well access.

Identification of subassemblies may involve, to use non-limiting examples, sensing of a magnetic ID tag, RFID tag, bar code, identifier, or the like. In addition, or alternatively, robotic tool assembly 178 may identify subassemblies 172 based on their placement within a storage location 194, which information may be stored on memory of robotic tool assembly 178. In essence, identification of subassemblies 172 allows robotic tool assembly 178 to retrieve the appropriate subassembly in order to assemble the correct downhole tool 174 to perform a pre-specified operation within wellbore 122.

As alluded to above, equipment for assembling and disassembling downhole tool 174 may include, to use non-limiting examples, robotic arms 192, 193, pistons, sprockets, belts, chains, hydraulic flow lines, conveyors, a power source, control electronics, housings, pulleys, fasteners, rotors, motors, connectors, cables, sensors, valves, transmitters, combinations thereof, or the like. The specific mechanisms used to form downhole tool 174 are diverse and should not be limited to the examples shown and described in the figures. However, in general, assembly of downhole tool 174 comprises connecting two or more subassemblies 172 together. The process for connecting subassemblies may be performed iteratively for multiple subassemblies 172 until a complete downhole tool 174 is built. Accordingly, downhole tool 174 may comprise any suitable number of subassemblies 172, for example, between 2 and 25, or any ranges therebetween.

Generally, each subassembly 172 may be wet connection compatible and latch into each subassembly 172 or unlatch for disassembly. In other examples, each subassembly 172 may be threaded with an auto make up/break out machine. Connections between subassemblies 172 may comprise, to use non-limiting examples, spun-in (e.g., threaded) connections, pressed-in connections, combinations thereof, or the like. Such connections may be a single universal coupling, which may allow for ergonomic assembly, in some examples. "Universal coupling" in this context refers to identical or substantially identical connections between the various combinations of subassemblies 172, which streamlines the assembly process despite differences in structure or functions of a particular subassembly 172. In examples, connecting the two or more subassemblies 172 together may involve pushing subassemblies 172 together by applying opposite force axially and/or differentially to respective tubular bodies of subassemblies 172.

In one example, first robotic arm 192 may secure a subassembly 172 within an assembly space 203 and a second robotic arm 193 may secure a different subassembly 172. The two subassemblies 172 may then be positioned one on top the other within assembly space 203. One or more members (e.g., grippers 184) of robotic arms 192, 193 may then be hydraulically actuated to force, twist, or otherwise compress the two subassemblies 172 together. In this example, robotic arms 192, 193 may be structurally formed as part of or otherwise securely attached to housing 179, such as to a base connected to a wall, floor, or other structure disposed within housing 179, as illustrated. Further, robotic arms 192, 193 may be configured to retrieve or place batteries 175 to and from charging station 186, for placement into or removal from ports 177 of individual subassemblies 172. Only two robotic arms 192, 193, are shown in this figure, however, robotic tool assembly 178 may comprise a single robotic arm, more than two (e.g., 3, 4, 5, etc.) robotic arms, or no robotic arms, in some examples.

As illustrated, a vertical lubricator 170 may be disposed above subsea housing 179. Vertical lubricator 170 may be utilized to form and build downhole tool 174. For example, during assembly of downhole tool 174, which may comprise a tool string, subassemblies may be added from the bottom with a cable head/wireline or other deployment device(s) 182 pulling downhole tool 174 high into vertical lubricator 170 as subassemblies 172 are added to downhole tool 174.

While building downhole tool 174, bottom valve 166 may be closed and top valve 176 may be open. This may allow access to robotic tool assembly 178 while keeping wellbore 122 separate, as will be discussed in greater detail (e.g., with reference to connection well 123 of FIG. 5). Building downhole tool 174 may comprise robotic tool assembly 178 selecting one or more subassemblies 172 and placing each subassembly 172 in a proper order. Subassemblies 172 that operate at the bottom of downhole tool 174 may be placed first within assembly space 203 of robotic tool assembly 178. Additional subassemblies may then be stacked and connected to each other until all subassemblies 172 have formed a downhole tool 174 that is created for an intended downhole operation within wellbore 122. In examples, the top-most subassembly 172 of downhole tool 174 may comprise telemetry for communication while operating as well as rechargeable batteries for downhole power. Downhole tool 174 may be characterized as self-powered, surface-powered, or a combination. As used herein, "self-powered" refers to electrical power that is delivered without any tethered connection. For example, a downhole tool 174 may be a self-powered tool, e.g., with batteries. As used herein, "surface-powered" refers to electrical power that is delivered via a tethered connection. For example, a wireline could be surface-powered. A "surface" in this context may refer to either a surface at the sea-floor and/or a surface at sea level. Downhole tool 174, robotic tool assembly 178, or both may be characterized, in some examples, as self-powered, surface-powered, or a hybrid thereof. For example, the amount of power used by robotic tool assembly 178 and/or downhole tool 174 may originate directly from a surface in an amount from about 0% to about 30%, about 30% to about 60%, about 60% to about 100%, or any ranges therebetween.

Thus, downhole tool 174 may be assembled within assembly space 203 of robotic tool assembly 178. Following assembly, robotic tool assembly 178 may then deploy downhole tool 174 into wellbore 122. In this example shown, this may involve conveying downhole tool 174 on a wireline or cable through a well access 230, a passageway 240 extending through subsea tree 120, and optionally, through another portal (e.g., hatch, door, etc.) to enter wellbore 122. In examples, valves 166, 176 may be used to equalize pressure across portals, to be discussed in greater detail in later figures. In this figure, well access 230 is functionally coupled to a servomotor 212 operable to open and close well access 230 when pressure thereacross is equalized. Once downhole tool 174 is ready to be deployed, for example, top valve 176 may close and/or bottom valve 166 may open, and deployment device(s) 182 lowers downhole tool 174 into wellbore 122. In some examples, deployment device(s) 182 may lower downhole tool 174 to a launching area whereupon downhole tool 174 may be released or reattached to another tether, and then launched to perform a downhole operation in wellbore 122.

Once deployed, downhole tool 174 may traverse wellbore 122 to any depth and perform the desired wellbore operation. As mentioned previously, intervention operations may include, without limitation, milling, valve shifting, brushing, bailing, routine pressure balancing. Others may include casing inspections, logging (e.g., acoustic, electromagnetic, nuclear magnetic resonance, gamma ray, etc.) or other wellbore measurement operations (e.g., fluid sampling). Traversal of wellbore 122 by downhole tool 174 may be performed on a conveyance, such as a wireline, or may be performed autonomously by downhole tool 174, such as when the downhole tool 174 is an untethered robot. In untethered examples, the downhole tool 174 may navigate wellbore 122 autonomously or semi-autonomously, and may thus be equipped with traction capabilities, propulsion, flow-assisted conveyance systems, buoyancy control systems, intervention equipment, and/or other subsystems for navigating and operating within the wellbore, to be discussed later in greater detail.

During operations with downhole tool 174 in wellbore 122, sea bed server 138 (e.g., referring to FIGS. 1A, 1B) may monitor operations to determine the effectiveness of an operation and if the operation has concluded. Accordingly, downhole tool 174 may communicate with sea bed server 138 (e.g., referring to FIGS. 1A, 1B), for example, via an intermediate communication device housed at robotic tool assembly 178. In other examples, however, downhole tool 174 does not communicate with sea bed server 138 or robotic tool assembly 178 but stores operational data on memory which is downloaded upon docking (e.g., docking station 186 of FIG. 7) or after retrieval and/or reuptake of downhole tool 174 into robotic tool assembly 178. Such data may then be conveyed to sea bed server 138 after download. Once an operation has concluded, sea bed server 138 (e.g., again referring to FIGS. 1A, 1B) may instruct robotic tool assembly 178 to retract downhole tool 174 from wellbore 122. In other examples, downhole tool 174 may operate primarily based on a job plan without needing to wait for instructions from sea bed server 138. For example, where the downhole tool 174 is untethered, rather than instructing robotic tool assembly 178 to retract downhole tool 174, a signal may be relayed to downhole tool 174 to cause it to autonomously return to robotic tool assembly 178, such as by using an internal navigational subsystem. This may involve activating traction devices/mechanisms (e.g., rollers), deploying a sail, opening a chute, using a buoyancy control system to change its buoyancy, activating hydraulic or mechanical propulsion, engaging steering mechanisms, combinations thereof, or the like, of downhole tool 174, to be discussed in greater detail later.

As the operation is ongoing or at the end, CCU 128 may use telemetry mechanism 134 (e.g., referring to FIGS. 1A, 1B) to communicate and monitor downhole tool 174. Telemetry mechanism 134 may relay information of operation, well status as well as request any additional assets needed within robotic tool assembly 178 to further and/or complete any operation designated for downhole tool 174. Such additional assets may include, for example, replacement batteries, replacement subassemblies, replacement cleaner fluid, etc., to be delivered to robotic tool assembly 178. For example, telemetry mechanism 134 (e.g., referring to FIGS. 1A, 1B) may be used to request replacement subassemblies or batteries from the surface. Telemetry mechanism 134 may comprise one or more devices that work together to move information and data from downhole tool 174 to a user on surface 103. For example, downhole tool 174 may comprise a subassembly 172 that may house communication equipment to communicate with surface computers. This communication equipment may include equipment to interface with a telemetry system based on sonar or telemetry over cable. Information handling system 146 (e.g., also referring to FIGS. 1A, 1B) within CCU 128 may send information on the job plan to be executed by one or more robots, tools to be assembled/disassembled, and additional tools and/or subassemblies dispatched from surface 103 to robotic tool assembly 178. Robotic tool assembly 178 may send information to surface 103 related to a robot location, robot operation log, health, tool storage information, assembly/disassembly status, power delivery system status, tool health, tools needed, completion equipment health and operation logs etc.

In examples, downhole tool 174 may comprise a subassembly 172 that may further monitor the pressure in wellbore 122 via a pressure sensor. Where used, such a pressure sensor may be utilized to measure modulated pressure pulses that may originate from downhole tool 174. These pulses, which may be sensed by pressure sensor in these examples, may be digitized by a CCU 128 in telemetry mechanism 134 and then demodulated and sent in real-time from downhole tool 174 to robotic tool assembly 178. The information sent may comprise information and data as to the operational and health log of downhole tool 174. In other examples, subassembly 172 may further comprise a flow sensor that may monitor the flow rate of mud within wellbore 122. Thus, flow sensor may monitor modulated flow pulses originating from downhole tool 174, in some examples. As before, these pulses may be digitized in a controller and then demodulated to get the information sent in real-time from downhole tool 174 to robotic tool assembly 178. The information sent may comprise information and data as to the operational and health log of downhole tool 174.

Subassembly 172, which may comprise a telemetry mechanism, may further comprise a house modulator/demodulator unit(s) to communicate with downhole completion equipment via wired-pipe telemetry. This telemetry system will bring information from the sensors embedded with the downhole completion equipment. Along with the sensor data, downhole completion equipment will wirelessly communicate with downhole tool 174 when it is in proximity to the downhole completion equipment. Completion equipment may then transfer data downloaded from downhole tool 174 to CCU 128 on the surface via this wired-pipe telemetry. The data transmitted from downhole tool 174 may further comprise information and data as to the operational and health log of downhole tool 174.

Following wellbore operations, robotic tool assembly 178 may disassemble and clean downhole tool 174. Disassembly of downhole tool 174 may be performed using the same, or different, equipment used to assemble the downhole tool 174. For example, robotic tool assembly 178 may comprise separate systems, one for assembly and another for disassembly, which may be housed in separate regions of robotic tool assembly 178.

Cleaning may involve, for example, treating the downhole tool 174 or one or more subassemblies 172 thereof with cleaning equipment, which may be disposed inside or outside housing 179. In the illustrated example, cleaning equipment comprises a retrievable tank 204 coupled to a nozzle 169 disposed on robotic arm 192 by a flexible conduit 206. Alternatively, or additionally, however, cleaning equipment may comprise a series of wipers, cleaners, brushes, sprayers, or any other mechanical or chemical means of removing wellbore fluids from the external surfaces of the downhole tool 174. Cleaning may be performed before, during, and/or after disassembly within or at robotic tool assembly 178, and may involve pressurizing cleaning fluid (e.g., seawater, cleaning agents, cleaner fluid, etc.) with a pump. Following disassembly of one type of downhole tool 174 following a wellbore operation, a given subassembly 172 may be reused to assemble the same type, or another type, of downhole tool 174 and used to perform one or more additional operations. In other examples, downhole tool 174 may be reused in a second wellbore operation without disassembly or following partial disassembly/reassembly.

In examples, robotic tool assembly 178 may also remove batteries 175 from ports 177 of subassemblies 172 or downhole tool 174 and place batteries 175 in a charging station 186. If, for example, the intervention operation is not completed or a second intervention operation is selected, downhole tool 174 may be connected to a second battery or plurality of batteries that may be fully charged to perform a second operation. As illustrated, batteries 175 be configured to interface, e.g., dock, to a corresponding port 177 of a given subassembly 172. Removal and/or placement of batteries in port 177 may be performed using the same, or different, equipment used to assemble and/or disassemble downhole tool 174.

Other methods of assembling and disassembling downhole tool 174 with robotic tool assembly 178 may involve, without limitation, making connections between subassemblies by utilizing a slotted housing (e.g., slotted housing 210 of FIGS. 3A, 3B, 4A, 4B, 4C). In examples, at least a portion of a slotted housing is positioned in robotic tool assembly 178, which may hold and/or prepare a subassembly 172 to be connected as a part of downhole tool 174. In further examples, a slotted housing may be rotated by command or controller instructions from an information handling system 146 and/or bed server 138 to select a desired subassembly module slot.

Figure 3A:
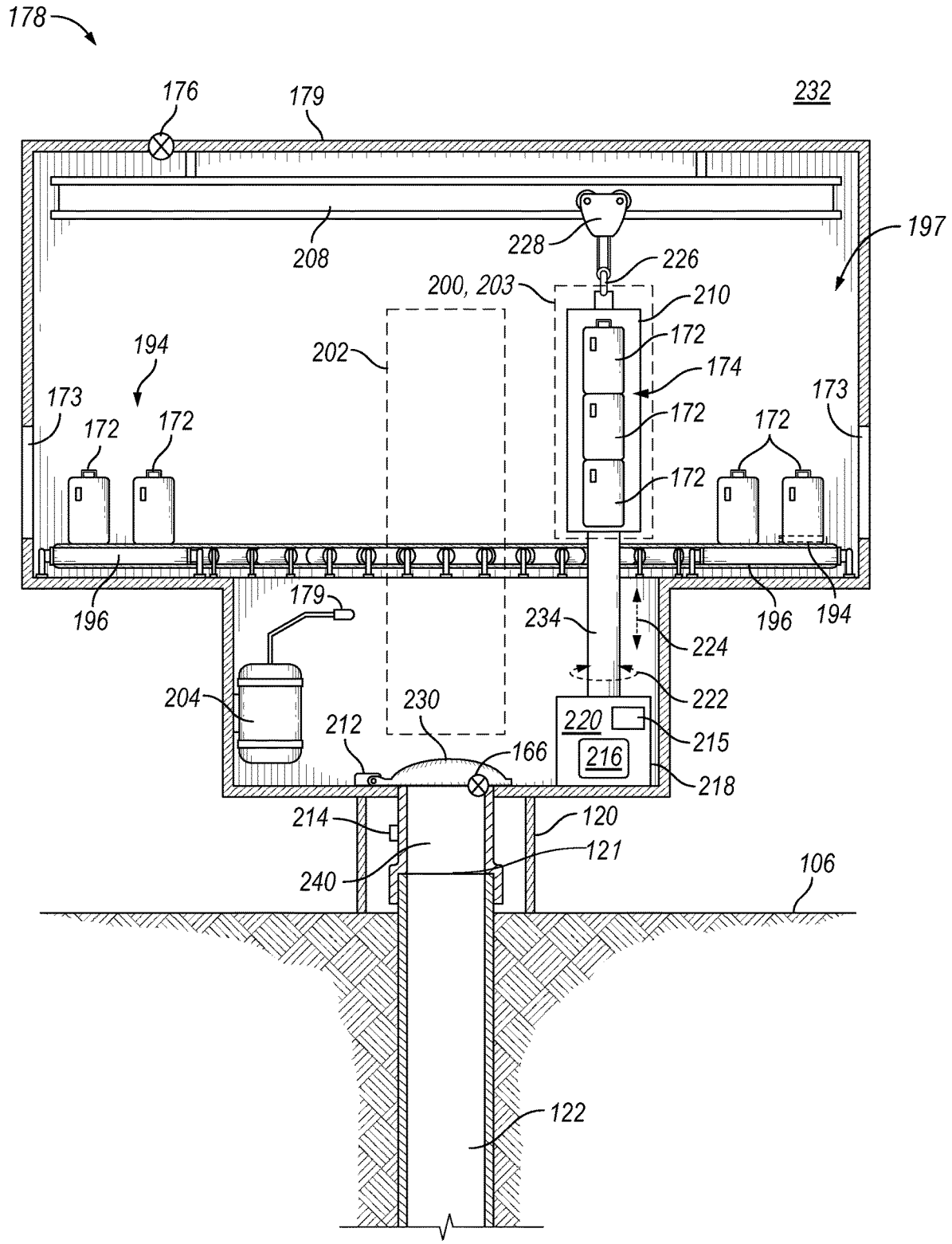
FIG. 3A illustrates a schematic diagram of another example of a subsea tree and a robotic tool assembly in a subsea environment during assembly of a downhole tool, in accordance with one or more embodiments of the present disclosure.
Figure 3B:
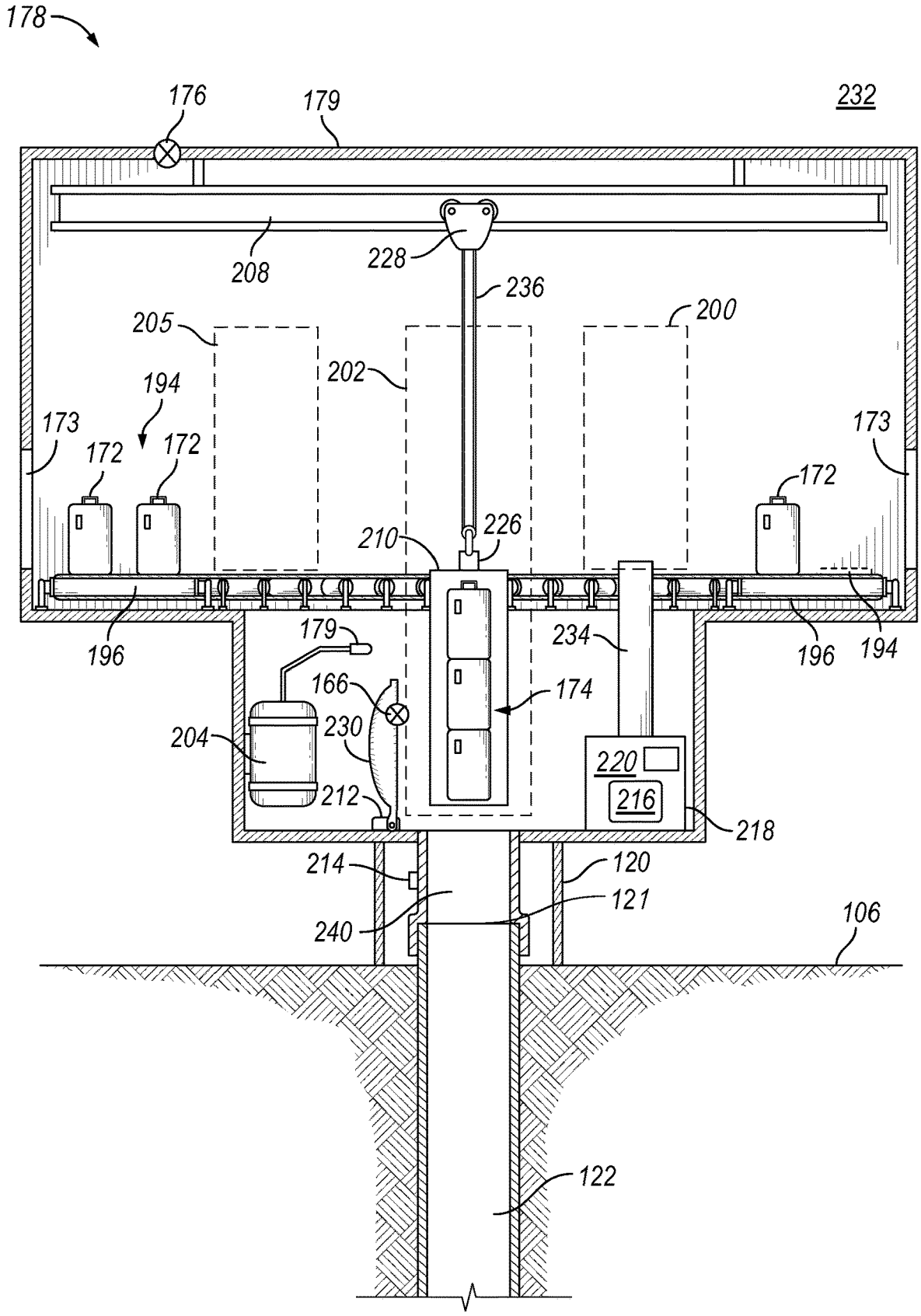
FIG. 3B illustrates a schematic diagram of the example subsea tree and robotic tool assembly of FIG. 3A during deployment of the downhole tool in a wellbore, in accordance with one or more embodiments of the present disclosure.

Accordingly, FIGS. 3A and 3B show schematic diagrams of another example of a robotic tool assembly 178 in accordance with some examples of the present disclosure. It should be understood that there may be crossover between the principles taught herein with respect to the examples shown in FIG. 2 and FIGS. 3A and 3B. Namely, while not shown in FIG. 2, certain features of FIGS. 3A and 3B may be implemented in FIG. 2, and vice versa, without departing from the scope and spirit of the disclosure. However, in this example, robotic tool assembly 178 comprises a slotted housing 210. FIG. 3A schematically shows one such example of a slotted housing 210 system during assembling of downhole tool 174 within a slotted housing 210 disposed within subsea housing 179.

With more specific reference to FIG. 3A, robotic tool assembly 178 may comprise a slotted housing 210 which may be removably or non-removably attached to a shaft 234 connected to a drive 220 in this example. During assembly of downhole tool 174, drive 220 may impart rotational and/or vertical movement to the shaft 234, schematically indicated at lines 222 and 224, respectively, which may be in turn conveyed to slotted housing 210. This may involve, for example, conveying hydraulic pressure to the shaft 234. Other designs are possible to impart rotation and/or vertical movement of slotted housing 210 without a shaft. In this example, however, drive 220 comprises one or more motors 216, which are disposed within a housing 218 disposed within subsea housing 179 of the robotic tool assembly 178. A controller 215 may control the drive 220. In examples, drive 220 may be configured to rotationally and/or linearly actuate the shaft 234 in accordance with instructions, for example, from sea bed server 138 to construct a particular type of downhole tool. Such instructions to construct or disassemble downhole tool 174 may also result in the appropriate subassemblies 172 being transferred to/away from their respective storage locations 194 and conveyed, e.g., via one or more conveyance devices 196, to and/or from slotted housing 210. While this example shows shaft 234 as being offset from a central axis of robotic tool assembly 178, shaft 234 may alternatively be substantially centralized within housing 210 in some examples.

Prior to assembly within slotted housing 210, the individual subassemblies 172 may be injected into slot(s) 416 of slotted housing 210. In examples, conveyance device(s) 196 may move a selected subassembly 172 from storage location 194 to an area proximate slotted housing 210, at which point the same conveyance device(s) 196, or additional injection equipment may be used to orient the selected subassembly 172 in an appropriate position such that it is received into the slotted housing 210. Additional injection equipment may comprise, to use non-limiting examples, a piston, belt, linear track, electronic guidance, and/or other suitable mechanical means for ensuring the selected subassembly 172 is guided into the slot(s) 416 of slotted housing 210, and which may be disposed in or form part of slotted housing 210, in some examples. Conveyance device(s) 196 may allow, in some examples, subassemblies 172 stored in one region of slotted housing 210 to be conveyed to another region. In other examples, conveyance device(s) 196 may be configured to move a storage location 194 altogether. Without limitation, this may be achieved by moving (e.g., rotating) one or more internal and/or external structures of robotic tool assembly 178, such as by rotating the entire housing 179 about a central axis of direct well access 202, in some examples. In these examples, rotation of housing 179 and/or one or more internal or external structures thereof may be performed with a storage revolver. As used herein, "storage revolver" refers to a system comprising at least a motor and a power source, which transfers at least one subassembly or storage unit containing one or more subassemblies to another location relative to an assembly area such that the subassembly/ies may be retrieved from the new location and conveyed to the assembly area for autonomous make-up of a downhole tool.

In addition, slotted housing 210 may be equipped with sensors disposed proximate the slot(s) 416 to sense when robotic tool assembly 178 has delivered a subassembly 172 thereto, and motors coupled to an intake mechanism (e.g., roller, control arm, mechanical actuator, etc.) to grab the delivered subassembly and ingest it into an assembly space 203 within slotted housing 210.

In the illustrated example, storage locations 194 are circumferentially disposed radially outwards from a central axis of direct well access 202, with multiple subassemblies 172 being disposed in series with each other, each group (e.g., one, two, three, four, five, etc.) of subassemblies 172 being disposed between slotted housing 210 and an outer wall of housing 179 of robotic tool assembly 178. However, geometries/configurations of subsea housing 179 and storage location(s) 194 alternative to that shown in FIGS. 2, 3A, 3B are possible, to accommodate alternative packing of subassemblies 172 within robotic tool assembly 178. A plurality of slots 173 may be disposed at the outer wall to allow an external vehicle (e.g., underwater autonomous vehicle of FIG. 5) to stock, restock, or remove subassemblies 172 to/from storage locations 194. For example, one or more incoming (e.g., replacement) submodules from subsea environment 232 may be dispensed from an underwater autonomous vehicle (e.g., UAV 160 of FIG. 6) and injected into robotic tool assembly 178 via, for example, slot(s) 173. Outgoing (e.g., used, damaged, depleted, etc.) submodules may also be ejected out from robotic tool assembly 178 via slot(s) 173, to be recollected by the same, or another, vehicle in some examples, to be retrieved and conveyed to vessel 102 at surface 103. Upon receipt of an incoming submodule, robotic tool assembly 178 may then convey the submodule to the correct storage location 194 within subsea housing 179 using, for example, conveyance device 196. Conveyance device(s) 196 may comprise, without loss of any generality, a conveyor, conveyor belts, winch, linear track system, tractor arm, or suitable alternative means for transferring the correct subassembly 172 to and from the respective storage locations 194, slotted housing 210, and/or slot(s) 173. Conveyance device 196 may be attached to the subsea tree 120, subsea housing 179, or to an internal structure disposed therein.

Once downhole tool 174 is built, robotic tool assembly 178 may actively move downhole tool 174 from indirect well access 200 to a direct well access 202. In exemplary embodiments, this may involve removing downhole tool from the slotted housing 210 and then conveying the downhole tool 174 away from the assembly space, such as by lifting and then conveying the downhole tool 174 using, for example, linear track 208. In the example shown, however, an attachment device 226 affixed to a body of slotted housing 210 is attached to a corresponding attachment device 228 of linear track 208 such that the entire slotted housing 210 is removed from shaft 234 and conveyed to the direct well access 202 while the downhole tool is disposed therein. Thus, one or more pulleys, a grappling mechanism, or other attachment or deployment device, wireline, spool, a robotic arm, a piston, combinations thereof, or the like, may be used to convey slotted housing 210 and/or downhole tool 174 to direct well access 202. While the indirect well access 200 is shown as being offset from a central axis of robotic tool assembly 178, it may alternatively be substantially centralized with respect to robotic tool assembly 178, in some examples, e.g., disposed above direct well access 202.

Figure 4A:
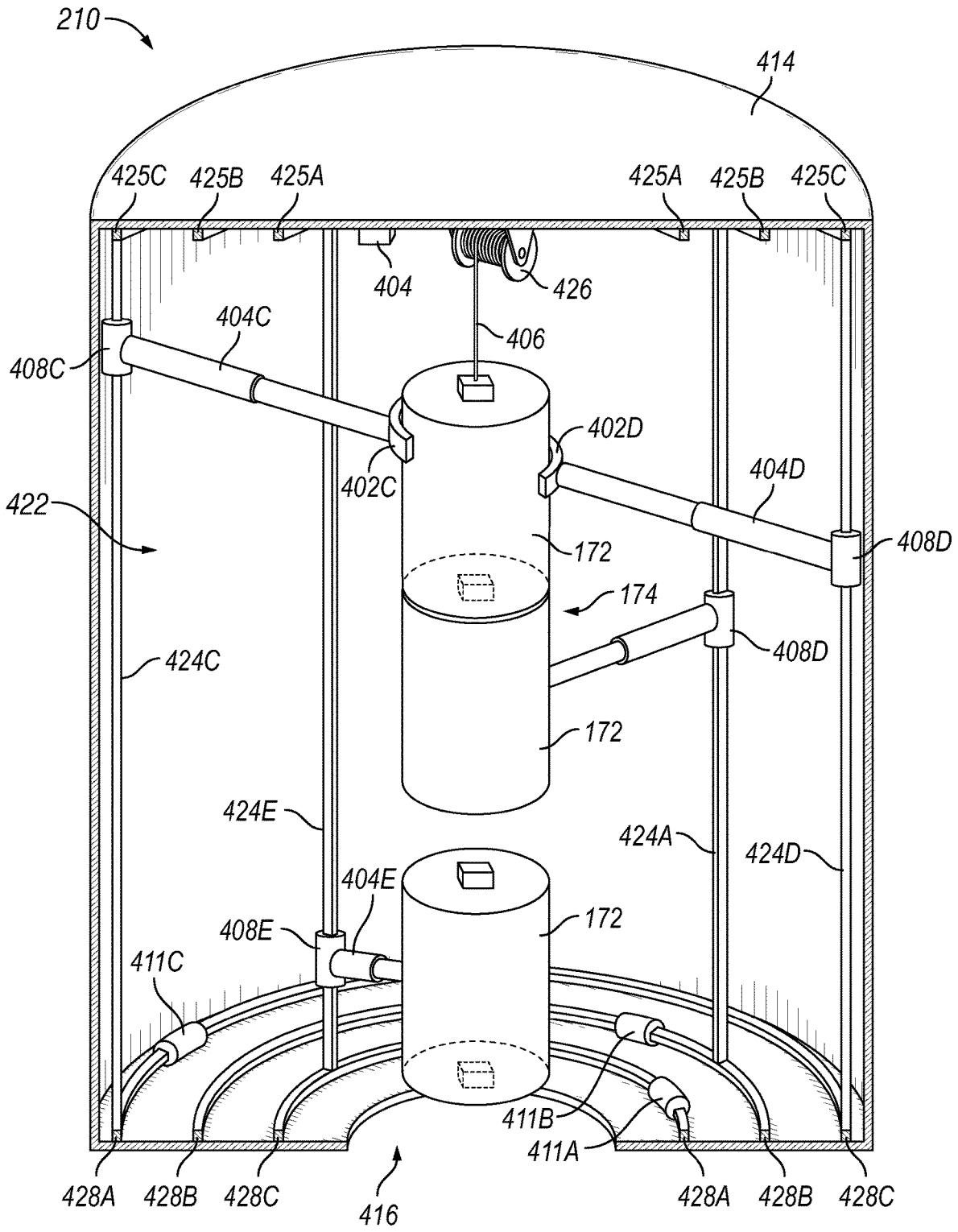
FIG. 4A illustrates a schematic diagram of a semi-transparent view of an example slotted housing configured to receive subassemblies, in accordance with one or more embodiments of the present disclosure.

Slotted housing 210 may comprise one or more slots (e.g., slot(s) 416 of FIG. 4A) in which one or more subassemblies (i.e., of the same type) may be injected/ejected. Such slots may be disposed laterally, e.g., radially, in the side of slotted housing 210, to allow subassemblies 172 to be inserted from the side. Alternatively, such a slot may be disposed at the bottom of slotted housing 210, such as in the manner shown in FIGS. 4A, 4B, and 4C, to allow subassemblies 172 to be inserted from below. Yet alternatively, at the top of slotted housing 210 to be inserted from above. As illustrated, slotted housing 210 may provide an assembly space 203 for assembling downhole tool 174. Slotted housing 210 may also comprise one or more slots in which cryogenic charging may be performed for subassemblies 172 that may utilize cooling protection for downhole operations. In examples, super cooled gas in liquid form may be injected into a cooling subassembly 172. Such cooling gas may be liquid nitrogen for example. Additionally, subassembly 172 may then use the liquid nitrogen coolant for circulating around control electronics or other systems in downhole tool 174 to keep downhole tool 174 within operational temperature limits underhole conditions that have temperatures much higher than the temperature limits of downhole tool 174.

Cleaning area 205 may allow for safe cleaning of well debris and chemicals, such as cuttings, liquids, asphaltenes, wax, and/or the like from subassemblies 172 to make them ready for another run. This functionality may also be integrated into a vertical lubricator (e.g., vertical lubricator 170 of FIGS. 2, 6, 7), or into slotted housing 210 as well. In examples, a retrievable tank 204 where debris, used solvents, and wastes from a cleaning operation is used. This allows cleaning equipment to displace sea water, e.g., through a one-way valve, so that it may be sent to surface when desired, whereupon it may be emptied, cleaned, and then re-deployed. In the example shown, retrievable tank 204 is fluidically coupled via a flexible conduit 206 to first robotic arm 192, which may be equipped with sprayers and/or nozzles 169 for cleaning a retrieved or disassembled downhole tool with pressurized cleaning fluid (e.g., sea water and/or cleaning agents pressurized with a pump). In some examples, fluids used to clean a retrieved or disassembled downhole tool may be kept apart from some or all of internal region 197 (e.g., direct well access 202, assembly space 203, indirect well access 200, etc.) to disallow contamination of wellbore fluids, debris, etc., therefrom.

When downhole tool 174 has been assembled and is ready to be run, slotted housing 210 may be conveyed (e.g., pivoted out, moved by linear track 208, etc.) to direct well access 202 over wellhead 121 and then latched and sealed in place for tool string deployment when well access 230 is opened. In some examples, this may involve lowering a vertical lubricator (e.g., vertical lubricator 170 of FIGS. 2, 6, 7) onto wellhead 121 and/or conveying slotted housing 210 away from direct well access 202. Conveying slotted housing 210 away from the wellhead 121 allows slotted housing 210 to continue to be accessed even as downhole operations may be occurring.

Turning now to FIG. 3B, this figure schematically shows the slotted housing 210 system of FIG. 3A as the downhole tool 174 is being introduced into wellbore 122 following assembly, in accordance with some examples of the present disclosure. From direct well access 202, downhole tool 174 may be deployed into wellbore 122. Deployment may involve, in some examples, opening a well access 230 disposed between direct well access 202 and wellbore 122, such as by actuating servomotor 212 with electronics 214 to swing open/closed well access 230 after eliminating a pressure differential thereacross using valves 166, 176, for example. Opening of valves 166, 176 may serve to pressurize or depressurize direct well access 202, such as to match wellbore pressure or an ambient pressure at the sea-floor 106, depending on if downhole tool 174 is entering or exiting robotic tool assembly 178.

In examples, deployment of downhole tool 174 may involve removing downhole tool 174 from slotted housing 210 and then conveying downhole tool 174 to direct well access 202, and then through well access 230 and passageway 240 through subsea tree 120 and wellhead 121 to access wellbore 122. Such may involve, without limitation, conveying downhole tool 174 from slotted housing 210 to direct well access 202 using a conveyance device such as linear track 208 and/or attachment device 228. For example, when slotted housing 210 is non-releasably attached to robotic tool assembly, deployment may be performed without removing slotted housing 210 from shaft 234 but may involve displacing downhole tool 174 from slotted housing 210 following make-up of downhole tool 174, and then conveying the naked downhole tool 174 to direct well access 202 for deployment into wellbore 122 via a passageway 240 extending thereto.

In the example shown, however, slotted housing 210 is first removed from shaft 234 and then the entire slotted housing 210 containing downhole tool 174 is lowered to a launch area, whereupon downhole tool 174 is then conveyed away from slotted housing 210 and introduced into wellbore 122 through well access 230. Thus, as illustrated, wireline cable 236 may extend between slotted housing 210 linear track 208 via attachment devices 226, 228.

In a similar example to that shown, deployment may involve assembling downhole tool 174 within slotted housing 210 at a low pressure (e.g., ambient pressure at the sea-floor 106), scaling the slotted housing 210, pressurizing the slotted housing 210 to a high pressure (e.g., to match or approximate a wellbore pressure of wellbore 122), and moving the sealed, pressurized slotted housing 210 from the direct well access 202 and past well access 230, e.g., into subsea tree 120, connection well 123 (e.g., referring to FIG. 5), or even into wellbore 122, before opening the slotted housing 210 and launching the downhole tool 174 into the wellbore 122. Such examples may involve de-attaching downhole tool 174 from slotted housing 210 and re-attaching it to another conveyance device(s) (e.g., wireline) disposed at or below wellhead 121.

In other examples altogether, robotic tool assembly 178 may instead comprise a linear track system, which may be utilized in place of, or in addition to, slotted housing 210. In such examples, subassemblies 172 may be shifted (e.g., with a storage revolver) horizontally under a vertical lubricator in a lubricator chamber disposed between wellhead 121 and a vertical lubricator. Subassemblies 172 may be shifted back and forth on a train to be assembled inside vertical lubricator, or in a connection well, (e.g., connection well 123 of FIG. 5). Such examples may involve a cable and/or winch when selecting a desired subassembly to form a downhole tool. For example, an opening at the bottom of subsea housing 179 (e.g., at the top 125 of connection well 123) would open (e.g., via valve 166), and the deployment device(s) 182 would then lower subassembly 172 down to an assembly area 190 in the lower portion of connection well 123. Alternately there may be a latching system that holds downhole tool 174 in place, that releases when a subassembly 172 is ready to be lowered into assembly area 190.

FIG. 4A illustrates a schematic diagram of a semi-transparent view of an example slotted housing 210 configured to receive subassemblies from below, in accordance with one or more embodiments of the present disclosure. As illustrated, slotted housing 210 may comprise a housing 414 which houses a plurality of subassemblies 172 during assembly and/or disassembly of downhole tool 174. One or more (e.g., two, three, five, or more, etc.) of slot(s) 416 may be disposed in housing 414 to permit the subassemblies 172 to be injected into and/or ejected out from slotted housing 210. While only a single slot 416 is shown in this figure, which is shown as disposed at the bottom of the housing 414, it should be understood that slot(s) 416 may be disposed at any suitable location including, for example, on a cylindrical body of housing 414 to allow subassemblies 172 to be injected/ejected from the side rather than from below.

As illustrated, slotted housing 210 may contain assembling/disassembling equipment 422. Assembling equipment/disassembling equipment 422 may include diverse or types of mechanical means for gripping, moving, manipulating, pushing, twisting, conveying, suspending, and/or holding subassemblies 172 during make-up and/or disassembly of downhole tool 174. In this example, however, equipment/disassembling equipment 422 includes a plurality of gripping members 402*a-f* operationally coupled to motors 408*a-f*, such as via telescoping members 404*a*, 404*b*. Motors 408*a-f* may be disposed on a rotatable tracks 424 vertically disposed within housing 414, which may impart linear actuation through telescoping members 404*a*, 404*b* to gripping members 402*a-f* to frictionally engage subassemblies 172. While this example shows three subassemblies 172, slotted housing 210 may be configured to house any suitable number of subassemblies 172 necessary to form a complete downhole tool 174, for example, 4, 5, 6, 10, 12, etc., depending on the number of modules needed for a particular type of downhole tool 174. Accordingly, more than the number of motors 408*a-f* and rotatable tracks 424 may be included than what is shown in FIG. 4A. As illustrated, downhole tool 174 may be suspended by a cable 406 which is attached by a pulley 426 to a motor 405 in this example. Cable 406 may be used to suspend downhole tool 174, as well as raise or lower downhole tool 174 to an appropriate position within slotted housing 210. In other examples, assembling/disassembling equipment 422 may alternatively, or additionally, comprise other types of mechanical means for assembling and/or disassembling downhole tool 174, for example, rollers, troughs, wheels, bearings, belts, pistons, mechanical arms, hinges, actuators, etc., which may assist and/or replace rotatable tracks 424, cable 406, gripping members 402*a-f*, etc., in some examples. For example, motors 408*a-f* may be configured in some examples to vertically traverse rotatable tracks 424 which may raise and lower individual subassemblies 172 and/or downhole tool 174. Thus, motors 408*a-f* may each comprise one or more motors which may have x-axis and/or y-axis functionality, in some examples. A sensor (e.g., infrared sensor, optical sensor, or other suitable sensor, etc.) may be disposed at or near slot(s) 416 to detect if an incoming or outgoing subassembly 172 is being injected into/ejected from slotted housing 210. Detection of a subassembly 172 at or near slot(s) 416 may trigger an assembly or disassembly process or subprocess.

Figure 4B:
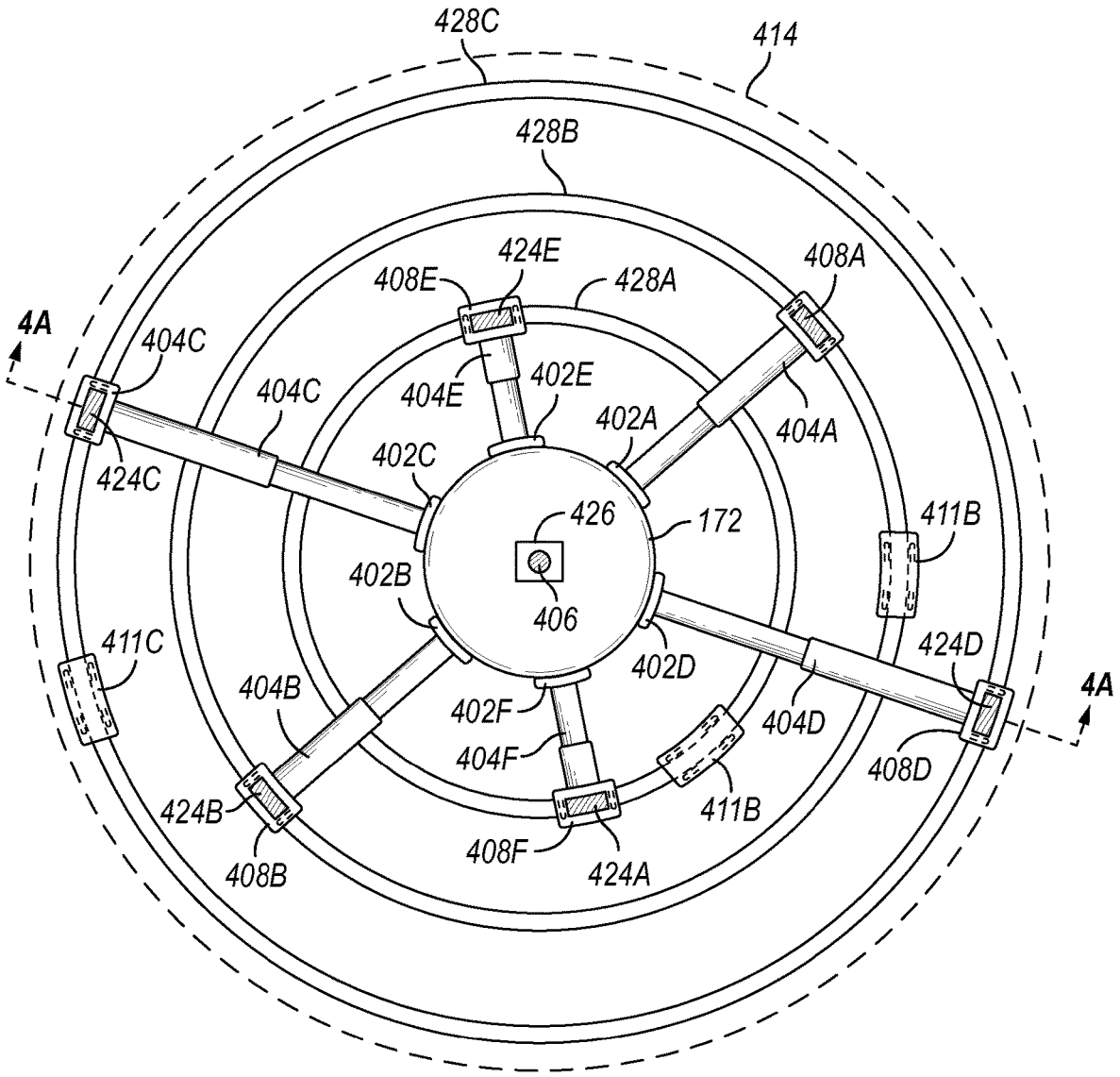
FIG. 4B illustrates a schematic diagram of a partially transparent top-down view of the example slotted housing of FIG. 4A, in accordance with one or more embodiments of the present disclosure.

FIG. 4B illustrates a schematic diagram of a top-down view of the example slotted housing 210 of FIG. 4A, in accordance with one or more embodiments of the present disclosure. As illustrated, downhole tool 174 is held in place by gripping members 402 which are concentrically disposed about subassemblies 172 of which downhole tool 174 is comprised. Motors 410*a-c* are operationally coupled to each circular track 425 to provide circumferential actuation thereto, effectively providing torque to subassemblies 172 by virtue of the frictional engagement between gripping members 402 and subassemblies 172. In examples where the connection between subassemblies 172 is spun-in, this allows slotted housing 210 to twist a given subassembly 172 or group thereof in either a clockwise or counter-clockwise direction while exerting a counterforce normal to the rotation to another given subassembly 172 or group thereof. Such rotation may also ensure that the appropriate radial orientation of the various subassemblies 172 is achieved prior to and during makeup of downhole tool 174. The amount of torque applied may be measured and controlled to ensure the connections between subassemblies 172 are reliable. In other examples, such as when the connections between subassemblies 172 comprises a pressed-in connection, cable 406 which is used in this example to suspend downhole tool 174 may be slackened to allow gravity to push downward on downhole tool 174 while pushing upward on a bottommost subassembly of downhole tool 174 using, for example, an upward-facing piston disposed beneath the bottommost subassembly. In other examples, motors 408*a-f* and gripping member 102*a-f* may be configured to apply the force necessary to push individual subassemblies 172 together to achieve the connection.

Figure 4C:
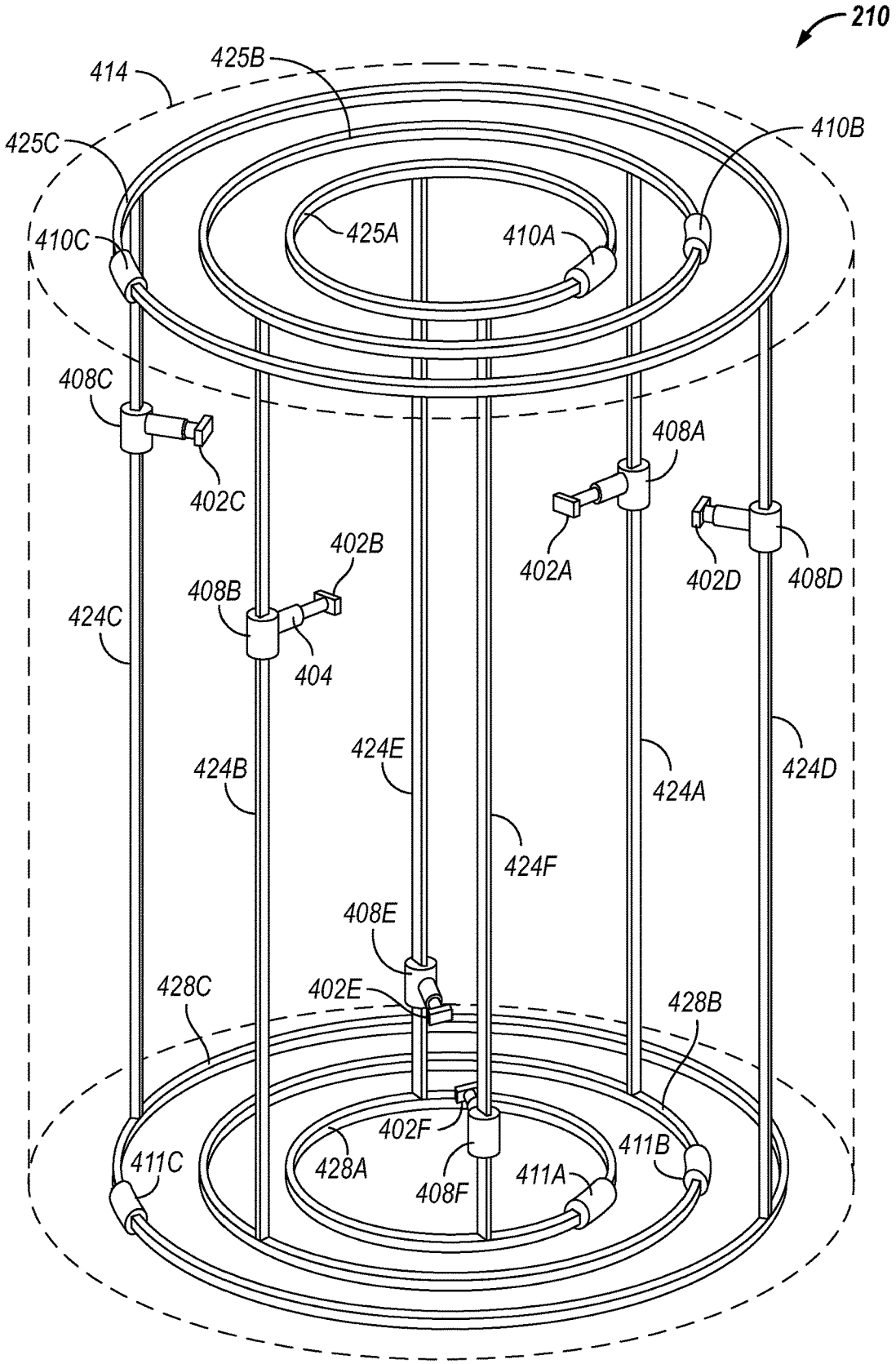
FIG. 4C illustrates a schematic diagram of a partially transparent perspective view of the example slotted housing of FIGS. 4A and 4B, with the downhole tool omitted for clarity, in accordance with one or more embodiments of the present disclosure.

FIG. 4C illustrates a schematic diagram of a partially transparent perspective view of the example slotted housing of FIGS. 4A and 4B, with the downhole tool omitted for clarity, in accordance with one or more embodiments of the present disclosure. Housing 414 is also omitted for clarity, to show upper and lower circular tracks 425*a-c*, 428*a-c* connected together by rotatable tracks 424. As illustrated, rotatable tracks 424 may extend along a length of slotted housing 210. Each rotatable track 424 may be connected at its respective upper and lower ends to a corresponding upper circular track 425*a*, 425*b*, 425*c* and lower circular track 428*a*, 428*b*, 428*c*, respectively, as illustrated. In examples, circular tracks and rotatable tracks may be rigidly connected (e.g., welded). In this manner, differential pressure applied by motors 410*a-c* and/or 411*a-c* to upper and lower circular tracks 425*a-c* and 428*a-c*, respectively, may be transferred via rotatable tracks 424 to gripping members 402 (e.g., referring to FIGS. 4A, 4B) to grip each subassembly 172 during make-up of downhole tool 174. This may allow subassemblies 172 to be rotated within slotted housing 210, such that they may be oriented properly relative to each other before being connected to an adjacent subassembly 172 during assembly of a downhole tool 174. In examples where the connection between subassemblies 172 is a spun-in connection, rotation of circular tracks 425*a-c* and 428*a-c* may provide the torque needed for the connection. Simultaneous actuation of upper and lower motors 410*a-c*, 411*a-c*, may ensure even rotation of rotatable tracks 424 around a central axis of slotted housing 210, which may prevent warping due to pressure unevenly applied thereto, in some examples. However, while this example shows two sets of circular tracks disposed at either ends of rotatable tracks 424 with corresponding sets of motors 410*a-c*, 411*a-c*, other configurations are possible, such as by using only a single set of circular tracks and corresponding motors, or greater than two (e.g., 3, 4, 5, 6, etc.). For example, a single set of circular tracks may be alternatively disposed at or near a midpoint of each rotatable track.

As alluded to in FIGS. 4A, 4B, motors 408 may be configured to apply an inward and/or outward radial force to gripping members 402 (e.g., referring to FIGS. 4A, 4B), for example, by expanding or retracting telescoping members 404. In addition, motors 408 may also provide vertical movement to downhole tool 174 or individual subassemblies thereof by raising/lowering individual subassemblies within slotted housing 210. Thus, motors 408 may have dual functionality of providing movement in both a radial and an axial direction, in some examples.

While FIGS. 4A-4C show one specific type of configuration of assembling or disassembling equipment 422 within housing 414 of slotted housing 210, it should be understood that other configurations are possible without departing from the spirit and scope of this disclosure. For example, in situations where the connection between subassemblies 172 (e.g., referring to FIGS. 4A, 4B) is a pressed-in connection, the force needed to push together adjacent subassemblies may be provided by, for example, a piston, linear actuator, or the like, disposed above and/or below downhole tool 174.

Figure 5:
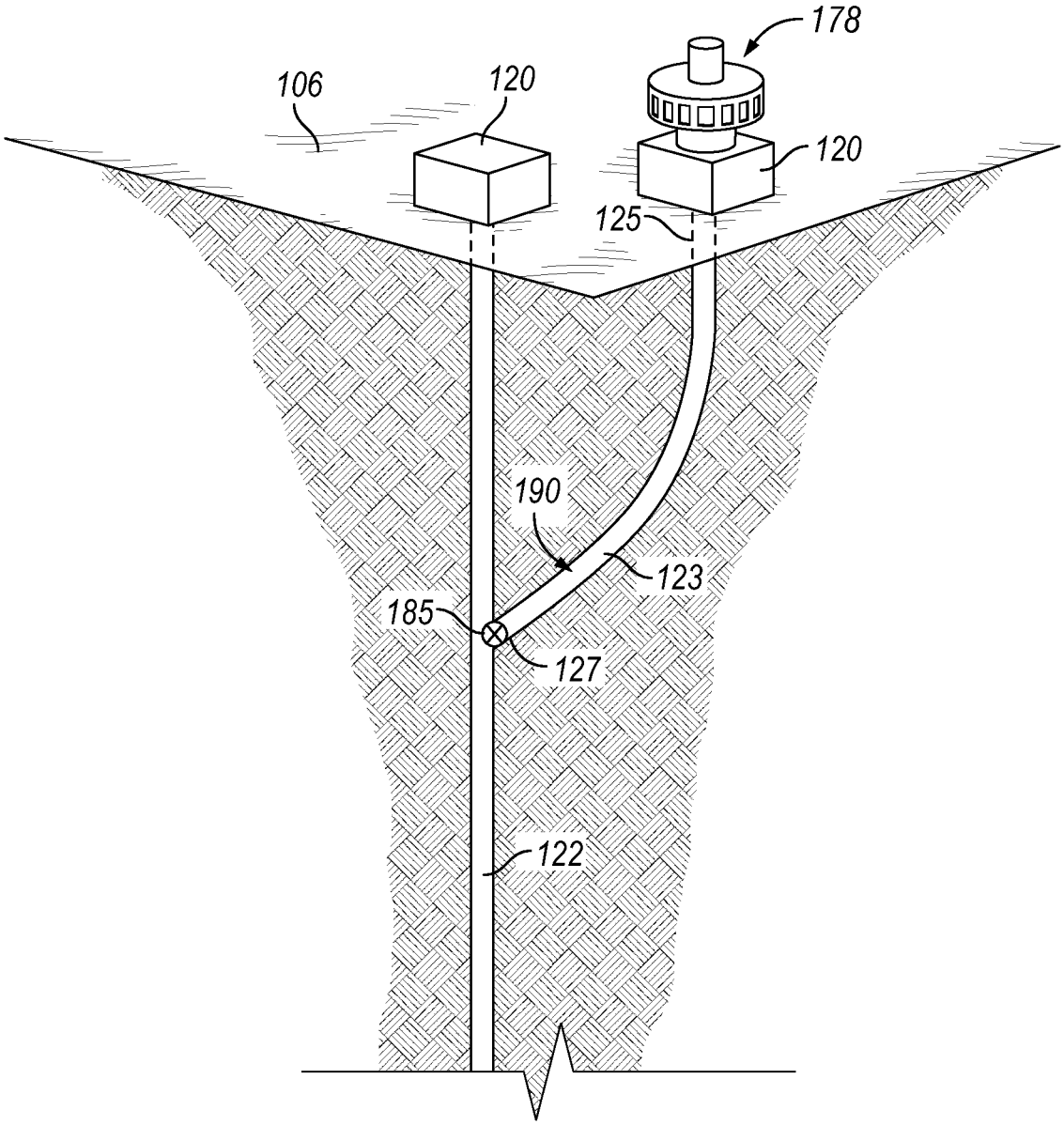
FIG. 5 illustrates an example of a subsea tree and a robotic tool assembly, in accordance with one or more embodiments of the present disclosure.

With more detailed reference to FIG. 5, this figure illustrates an example, in which downhole tool 174 may be assembled and disassembled on sea-floor 106 by a robotic tool assembly 178 that is connected to a well access portal. The well access portal may comprise a connection well 123 which may connect to wellbore 122, as illustrated. Connection well 123 may have open access to robotic tool assembly 178 and valving at the top 125 and bottom 127 (i.e., valve 185) that may connect and disconnect robotic tool assembly 178 to wellbore 122, which may be a producing well. In this figure, the valving at the top 125 and bottom 127 may serve to pressurize/depressurize connection well 123 by bringing its pressure in equilibrium with either wellbore 122, a subsea environment (e.g., subsea environment 232 of FIGS. 2, 3A), or an artificial pressure (e.g., internal pressure of subsea tree 120 or robotic tool assembly 178). In examples, this may eliminate a pressure differential across a well access (e.g., well access 230 of FIGS. 2, 3A, 3B), hatch, sliding door, or other portal connecting connection well 123 to robotic tool assembly 178 and/or subsea tree 120, or else a portal similarly disposed between connection well 123 and wellbore 122. While only two valves are referred to herein (e.g., referring to FIGS. 2, 3A, 3B), such pressurization/depressurization may be accomplished using more than two valves (e.g., three, four, five, ten, etc.) to ensure that a downhole tool assembled within robotic tool assembly 178 may traverse a passage between robotic tool assembly 178 and wellbore 122. In examples, such pressurization/depressurization may comprise bringing the pressure of connection well 123 in equilibrium with a wellbore pressure or a subsea pressure, as mentioned, or alternatively, an artificial pressure. Where used, artificial pressure may be an internal pressure of subsea tree 120 and/or robotic tool assembly 178, which may differ from both the ambient subsea pressure outside robotic tool assembly in some examples. For example, in embodiments where an assembly space within robotic tool assembly 178 is not in fluidic communication with the ambient subsea environment, the assembly space may be a dry, pressure-scaled environment, or even a wet, pressure-scaled environment. This may involve one or more pumps disposed within subsea housing 179 for expelling fluid (e.g., seawater, wellbore fluid, cleaner fluid, etc.) in some examples. However, the assembly space may be in fluidic and/or pressure communication with the ambient subsea environment, thereby eliminating the need for the assembly space to be pressure-sealed, in some examples. One or more additional pumps may be used to pressurize connection well 123.

Figure 6:
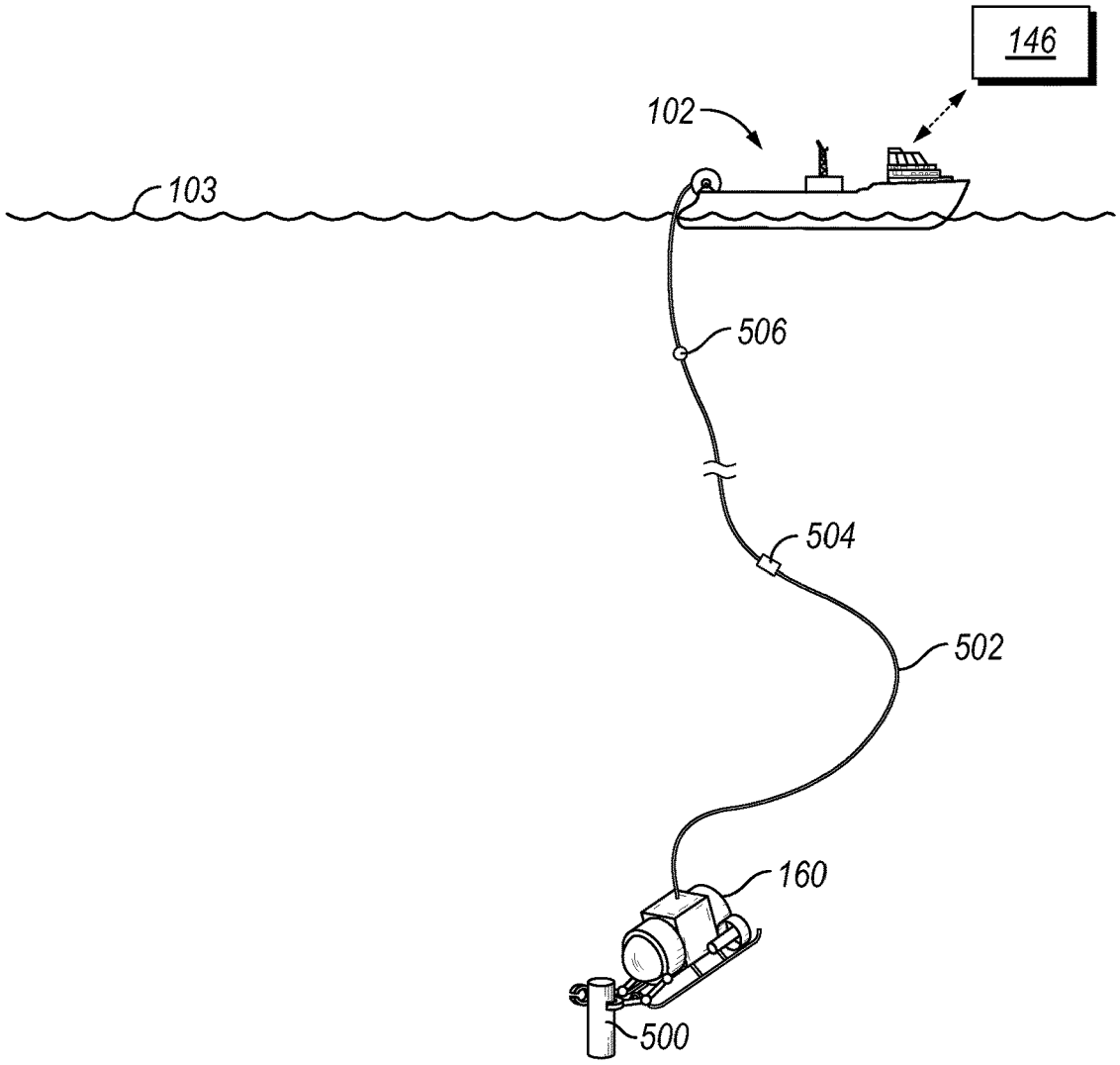
FIG. 6 illustrates an example of an underwater autonomous vehicle for delivering or extracting subassemblies to a robotic tool assembly, in accordance with one or more embodiments of the present disclosure.
Figure 6:
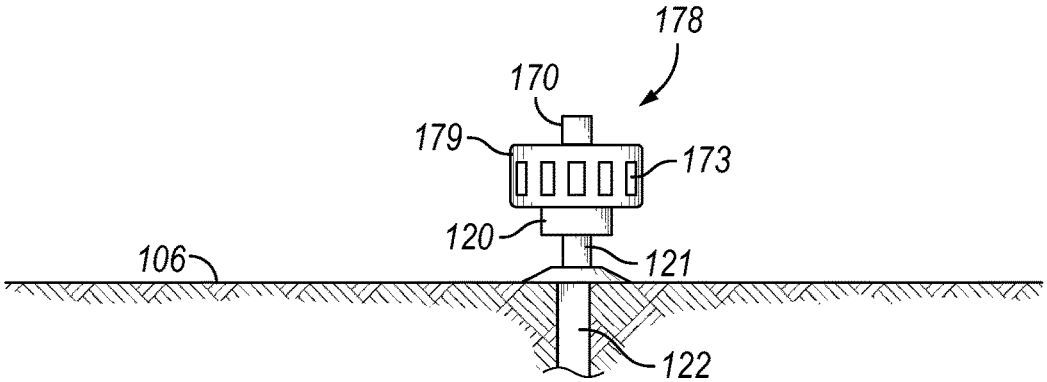

FIG. 6 illustrates a well system 100 with an underwater autonomous vehicle (UAV) 160. Subassemblies 172 used to assemble a downhole tool 174 in robotic tool assembly 178 may be deployed to and from the surface through UAV 160. UAVs 160 may be commanded to insert or retrieve subassembly 172 from a position in robotic tool assembly 178, e.g., through slot(s) 173, as previously discussed (e.g., referring to FIGS. 2, 3A, 3B). While this figure shows three slots 173, robotic tool assembly 178 may comprise any number of slots, for example, a single, a pair, or more than three (e.g., 5, 7, 10, etc.) slots. Robotic tool assembly 178 may comprise a slotted housing 210 or equivalent automated equipment to assemble/disassemble downhole tool 174. In examples, a subassembly 172 is disposed within carrier tube 500 at vessel 102. Carrier tube 500 is attached to UAV 160. Carrier tube 500 may then be conveyed down to the sea-floor 106, where either the carrier tube 500 or only the downhole tool 174 within carrier tube 500 is injected into robotic tool assembly 178. UAV 160 may be equipped and configured to deliver a single carrier tube 500 carrying a single subassembly, multiple carrier tubes each carrying a single subassembly, a single carrier tube carrying multiple subassemblies, or multiple carrier tubes each carrying multiple subassemblies. Advantageously, this may limit the number of trips needed to supply or resupply a robotic tool assembly 178.

As discussed, robotic tool assembly 178 may comprise slot(s) 173. Slot(s) 173 may be external slots of a housing 179 of robotic tool assembly 178 or else may be slot(s) 416 of a slotted housing 210 (e.g., referring to FIGS. 4A, 4B), in some examples. For example, in one or more embodiments, housing 179 may itself be or comprise part of the body (e.g., housing 414 of FIG. 4A) of slotted housing 210. Essentially, slot(s) 173 allows UAV 160 to deliver one or more (e.g., a plurality) of modules (e.g., subassemblies 172 batteries, etc.) to one or more internal regions (e.g., storage locations 194 of FIGS. 2, 3A, 3B) of robotic tool assembly 178. In examples where slot(s) 173 are the same as slot(s) 416, robotic tool assembly 178 may be simplified so that it essentially consists of a slotted housing 210 (e.g., referring to FIGS. 4A, 4B), or else a slotted housing 210 coupled to a vertical lubricator 170 (e.g., referring to FIG. 2). However, any suitable robotic tool assembly 178 may be used, such as those shown and described in FIGS. 2, 3A, 3B. In one or more examples, slot(s) 173 may cause one or more internal region(s) of robotic tool assembly 178 to be in fluidic and/or pressure equilibrium with a subsea environment 232 (e.g., referring to FIGS. 2, 3A, 3B). It should be understood, however, that slot(s) 173 may be designed to allow exchange between UAV 160 and robotic tool assembly 178 while preventing fluidic and/or pressure communication between the subsea environment and the internal region(s).

In examples, UAV 160 may have an on-board navigation system to propel subassembly 172 to and from vessel 102. To control precision navigation in the vicinity of well system 100, acoustic transmitters at various locations on well system 100 may be used to help guide UAV 160 to a location. Selective acoustic transmitters may be used to help steer UAV 160 to the correct slot 173 for example. One or more acoustic transmitters may be localized next to slot 173 which may be open for final alignment for the delivery or retrieval of subassembly 172. If the ocean currents are within acceptable limits a subsurface buoyed cable 502 with acoustic and light transmitters may be deployed to help UAV 160 follow it down to well system 100 disposed on sea-floor 106. Acoustic and optical transmitters 506 may be located at intervals along cable 502. Cable 502 may also contain autonomous propulsion units 504 that are used in unison to maintain cable 502 in a relatively vertical position against currents, in addition to a high load buoy lifting force to keep the line tight against the currents. Cable 502 may also be utilized for UAV 160 to attach to and slide up and down at least a portion of cable 502 to aid in guiding it to well system 100. In other examples, however, UAV 160 may be function without any cable 502, such as in some fully autonomous examples where UAV 160 is untethered.

UAV 160 may have sensors & navigation which may include one or more inertial measurement unit (IMU) sensors which may be a combination of precision mems gyroscopes, accelerometers, and magnetometers. Sensor measurements may be used to determine depth of UAV 160 in real time. In some examples, this information may be relayed to surface 103 in real time to inform an operator about the progress of a delivery or extraction operation, for example.

Operations performed by UAV 160 may be controlled by an internal controller (IC) subsystem. IC may comprise microcontrollers, memory, I/O processing, communication bus, etc. In examples, IC may use algorithms for autonomous operation of UAV 160. Inputs for this algorithm may include a job plan, as well as real time feedback. Based on these inputs, an algorithm may provide commands which may allow for UAV 160 to operate and function. In examples, IC may also log runtime operational parameters in its memory.

Figure 7:
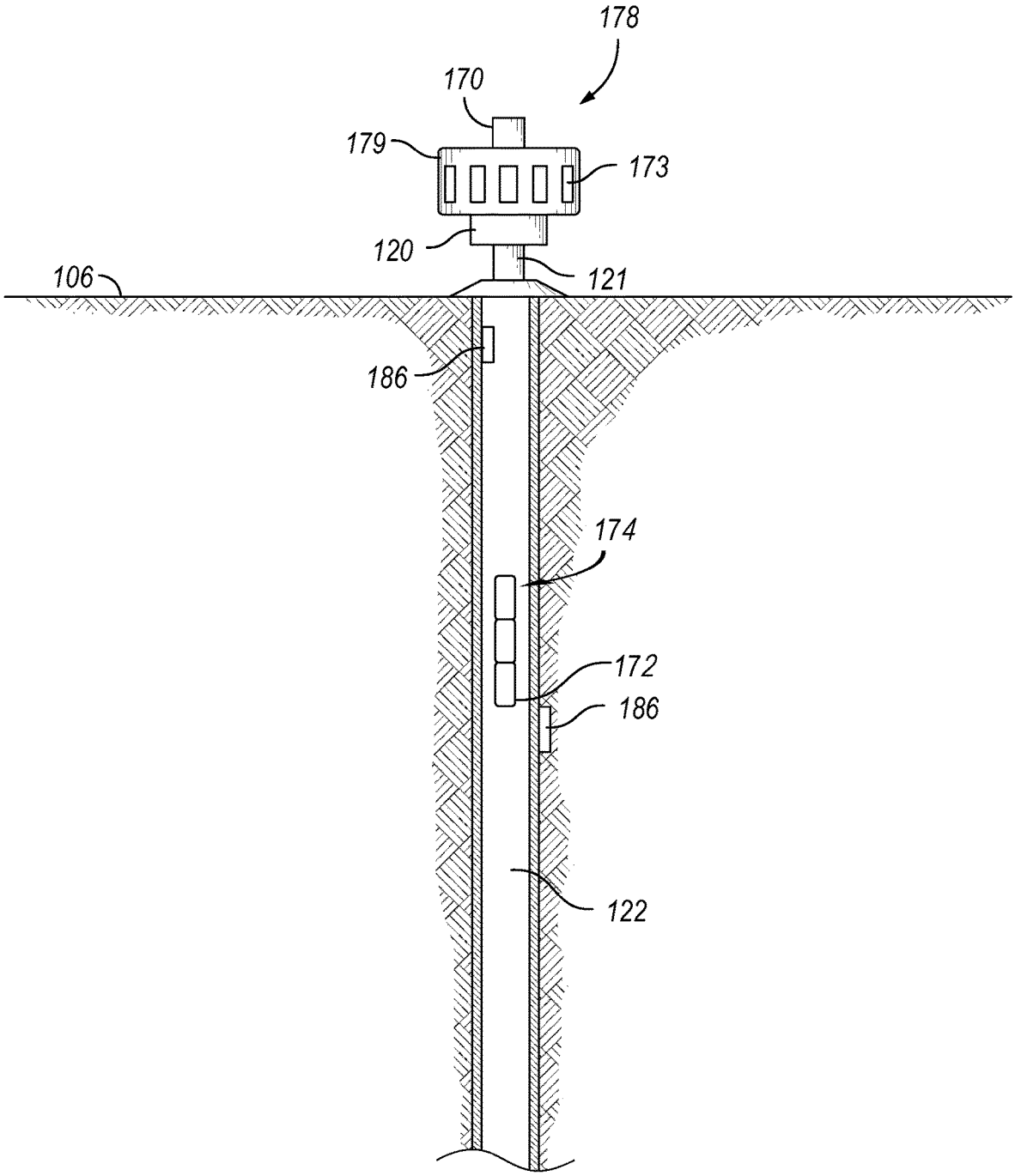
FIG. 7 illustrates an example of a downhole tool deployed in a wellbore from a subsea tree and robotic tool assembly, in accordance with one or more embodiments of the present disclosure.

FIG. 7 illustrates a downhole tool 174 deployed in wellbore 122. Following deployment from robotic tool assembly, downhole tool 174 may traverse wellbore 122. Downhole tool 174 may be deployed on a conveyance (e.g., wireline) or may navigate wellbore 122 autonomously. For example, downhole tool 174 may have treads or tires for frictionless centralization, roving, and positioning capability. As mentioned, downhole tool 174 may perform a variety of wellbore operations including, without limitation, logging, sampling, as well as various wellbore intervention operations.

In some embodiments, downhole tool 174 may utilize wired well systems for telemetry and for power. However, downhole power generation devices and wireless telemetry may allow downhole tool 174 to operate independently, without needing wired wells in some examples. As mentioned, downhole tool 174 may be deployed and utilized within wellbore 122. To perform all necessary tasks within wellbore 122, downhole tool 174 and its respective subassemblies 172 (e.g., referring to FIGS. 2, 3A, 3B, 4A, 4B) may comprise of a plurality of subsystems that may be utilized to perform a plurality of operations. As discussed in greater detail below, subsystems may comprise, without limitation, a buoyancy controller, flow assisted conveyance, energy storage, untethered mode communication, docking & release, sensors & navigation, central controller unit, traction system, intervention tools, and combinations thereof.

Buoyancy of downhole tool 174 may be manipulated in a manner similar to the example described for UAV 160 (e.g., referring to FIG. 6), except that buoyancy is controlled in a wellbore environment rather than an oceanic environment, and is therefore adapted to sink or float relative to density of wellbore fluids instead of seawater. In these examples, one or more modules of downhole tool 174 (e.g., subassembly 172) may include a controller subsystem may be used primarily for depth control of downhole tool 174. In examples, one or more subassemblies of downhole tool 174 may be filled with buoyancy increasing materials such as air filled ceramic balls or syntactic foam. During operation, buoyancy controller may intake fluid from wellbore 122, if decent into wellbore 122 is selected and may expel fluid if ascent is selected. In one embodiment, active buoyancy control may intake/expel continuously, so floating at a depth within wellbore 122 is achieved. In another embodiment, a buoyancy controller is used to augment the motive force delivered by traction system, discussed below. Active buoyancy control may make use of a linear actuated piston, driven by motor and ball screw, for example.

During operations, a reference depth is similarly provided to the buoyancy controller, for example by CCU 128 (e.g., referring to FIGS. 1A, 1B), which may also be based on a pre-loaded job profile for downhole tool 174. Actual measured depth may also be likewise provided to a buoyancy controller by a navigation subsystem of downhole tool 174, with a buoyancy controller computing error between the reference depth and actual depth and using a PID controller to adjust a piston position, for example. Thus, the controller intakes/expels controlled amount of well fluid out of downhole tool 174 to adjust its buoyancy. In another embodiment, CCU 128 determines the desired direction of travel. Travelling deeper into wellbore 122 may result in an increase in the amount of force applied to the air chamber while traveling towards the surface results in CCU 128 may result in a decrease in the amount of force applied to the air chamber. In one or more examples, the air in the air chamber may be created downhole. For example, the air in the air chamber may be created through electrical action, or a chemical reaction, as discussed in the foregoing. When batteries in the energy storage system go below a predetermined threshold, then all the fluid is expelled to aid with retrieval of downhole tool 174. In one embodiment, the pressure in the air chamber is greater than the hydrostatic pressure of wellbore 122. A motor may compresses fluid housed by downhole tool 174 to increase its density for entry into and/or descent further down wellbore 122. As with a UAV, downhole tool 174 may have a fail-safe feature such that in the event of system failure, battery loss, on-set inability to compress buoyancy fluid, or other event, expanding gas causes downhole tool's 174 buoyancy to increase and floats towards the sea-floor 106. Thus, an air chamber within a subassembly of downhole tool 174 may act as a fail-safe of downhole tool 174 that automatically induces a return to robotic tool assembly 178 in the event of a failure on downhole tool 174.

Materials used for downhole tool 174 to assist with the buoyancy may comprise light weight composites, thermoplastic composite, a filament wound assembly, dead weights, demagnetizing magnets, etc. Also, a subassembly of downhole tool 174 may have an umbrella, may be configured to deploy wipers, or may be configured to change the downhole tool's 174 diameter or else its fluid dynamic profile, for example, to a venturi shape. When batteries in the energy storage system go below a pre-determined threshold or when CCU 128 (e.g., referring to FIGS. 1A, 1B) identifies that downhole tool 174 is incapacitated, an umbrella may be opened to convey downhole tool 174 back to the sea-floor 106. In one embodiment, an umbrella acts as a fail-safe mechanism so that it automatically deploys in the event of failure or the sudden loss of battery energy downhole tool 174.

In downhole tools whose subassemblies include an energy storage subsystem, the media of energy storage may be battery (electro-chemical), fuel cell, or capacitor. For battery-powered downhole tools, the energy storage subsystem may comprise rechargeable batteries for powering the functions of downhole tool 174. Such batteries may be high temperature high pressure (HTHP) compatible to accommodate a variety of downhole environments, such as when wellbore 122 is deeper than conventional wells. For fuel cell-powered downhole tools, energy may be stored as hydrogen/oxygen in a closed system for which water is produced. Electrolysis may produce hydrogen and oxygen which may be stored in separate containers or absorbed to substrates such as but not limited to metal hydrides or stored as a chemical form such as but not limited to acid and oxidizers. Depending on the amount of time a downhole tool is expected to remain in a wellbore before being disassembled by robotic tool assembly 178, energy re-storage may take place over weeks at regular intervals or on demand as triggered.

Where used, an energy storage subsystem may also have connections to a battery charging infrastructure of a wellbore 122, for example, when downhole tool 174 is docked to a docking station 186. As illustrated, docking station 186 may be disposed within a wellbore such as at or near wellhead 121, as well as at one or more downhole locations. In other examples, an energy storage subsystem may be recharged following disassembly within robotic tool assembly 178. In some embodiments, downhole tool 174 (or a subassembly thereof) has a combination of rechargeable battery, ultra-capacitors, primary batteries, and a turbine-based power generator that converts some of the production flow energy of the wellbore 122 into electrical energy. Various charging mechanisms are possible, but may include for example, non-contact induction charging, non-contact capacitive-charging, or a wet-mate connector connection, to use non-limiting examples. The state of charge of a battery may be continuously monitored and reported to the CCU 128. The state of charge of the battery may be monitored by noting the open-circuit voltage of the battery, the closed-circuit voltage of the battery, the internal resistance of the battery, or the amount of charge delivered by the battery. The internal resistance of the battery may be estimated by comparing how the voltage of the battery changes with the current draw. Energy storage subsystem may optionally have a cooling system to keep batteries at lower temperatures, during extended operations in wellbore 122. Alternatively, the battery and/or the electronics may be housed in a flask to slow down temperature increase. Batteries may be mounted within one or more subassemblies 172 (e.g., referring to FIGS. 2, 3A, 3B, 4A, 4B) of downhole tool 174. These batteries may be replaced at the sea-floor 106 by robotic tool assembly 178 and, if the batteries are deemed end of life or non-rechargeable, a request for battery retrieval/replacement may be triggered to be delivered by UAV 160 (e.g., referring to FIG. 6).

With continued reference to FIG. 7, one or more subassemblies of downhole tool 174 may further comprise a packer that may be inflatable around at least a portion of the body of downhole tool 174. Downhole tool 174 may have capability to inflate and deflate the packer in a pattern, which may be based on the information downhole tool 174 is transmitting. This inflation/deflation may obstruct/free the flow of production fluid passing by downhole tool 174 at a given region of wellbore 122, thereby creating a telemetric pressure pulse. Essentially, this mechanism may modulate information on the pressure pulses. Alternatively, the modulated information may be carried on the variations in the flow velocity as measured at the surface. These pressure pulses may be sensed, for example at or by docking station 186, and then demodulated to interpret the information sent by downhole tool 174. The key to this concept is that downhole tool 174 adjusts the flow restriction around downhole tool 174 in order to digitally encode a downhole measurement. Suitable mechanisms for obstruction for obstructing production fluid may be, to use non-limiting examples, a variable seal (like an inflatable packer element), a variable drag component (like the umbrella, wiper, etc.), or a variable restriction (like a flow siren). Data may be encoded through pulse position encoding, amplitude modulation, frequency modulation, as well as differential versions of these encoding schemes. Variable restriction may result in a variable flowrate (as measured by the generator frequency) and a variable tubing pressure. The bits of the differential pulse position encoding are visible for the header, address, command, and checksum.

In wellbores which include a docking station 186, downhole tool 174 may dock to docking station 186 following deployment, such as when it enters wellbore 122 and/or after it performs a wellbore operation. During docking, batteries utilized by downhole tool 174 may be charged. Battery charger circuit may be part of docking station 186. Docking station 186 may be powered by either a power pack at sea-floor 106 or from a wireline connected to the surface power supply. While docked, a job plan may be downloaded from CCU 128 in docking station 186 to downhole tool 174. This job plan may define a wellbore operation to be performed, well depth to initiate the wellbore operation, well depth to stop the wellbore operation, quality check criteria, references for various control systems, parameters to log in the memory, combinations thereof, etc. In addition to a job plan, well survey and casing tally information may also be downloaded from CCU 128 in docking station 186 to downhole tool 174. Downhole tool 174 may provide this information to the navigation system to determine the real time depth during operations.

Command to release (i.e., undock) downhole tool 174 from docking station 186 may either come from a user command from surface to docking station 186 or based on a pre-programmed condition. To execute the release command, docking station 186 may unlock downhole tool 174 and let downhole tool 174 separate from docking station 186 and start its descent into wellbore 122. For docking, downhole tool 174 may move to docking station 186, with either its own power or with flow assisted conveyance. Downhole tool 174 may have sensors to align itself with docking station 186 and then push itself to dock to docking station 186. After downhole tool 174 has completed a downhole operation and has docked to docking station 186, the mission log from downhole tool 174 memory may be uploaded to docking station 186. A log file may then be sent to surface from docking station 186. Docking station 186 may be, without limitation, in a side pocket, dead-end section, section with a larger flow area, etc., of wellbore 122.

One or more subassemblies of a downhole tool 174 may comprise sensors and a navigation subsystem which may have inertial measurement unit (IMU) sensors which may be a combination of precision mems gyroscopes, accelerometers, and magnetometers. In addition, downhole tool 174 may also include casing collar locator (CCL) sensors. Well survey and casing tally information (downloaded from the docking system) along with the sensor information may be used to determine the depth of downhole tool 174 in real time. More precise location information may be included at the valves that may be actuated and at the sensors that may need replacing or measuring. While profiles may be used for this more precise axial and circumferential location, profiles in one or more tubulars 124 (i.e., casing, production tubing, etc.) may be eroded with time and may be filled by scale and debris. Markers may be provided through an electromagnetic source (such as a permanent magnet, an RFID tag, or an NFC tag) or by a nuclear source. A plurality of magnets may be arranged such that they form a unique magnetic pattern for the specific location. The RFID and NFC tags may have a unique identifier for a specific location. Additional sensors may comprise bore hole pressure and temperature sensors. Downhole tool 174 may also have sensors to detect and establish communication with permanently mounted completion electronics in the well. Once communication is established, downhole tool 174 may download operational & health logs from these completion electronics.

As with a UAV 160, one or more operations performed by downhole tool 174 may be controlled by an internal controller (IC) subsystem. An IC may also control the inflation/deflation of the packers for untethered mode communication with the docking station 186, in some examples. In examples, commands issued by an IC may be determined from algorithms for autonomous operation of downhole tool 174. Inputs for this algorithm will be the job plan and may also include real time feedback from any subsystem herein described in this disclosure. Based on these inputs IC may provide commands to the same subsystem that transmitted the input or to any other subsystem of downhole tool 174. This may allow for downhole tool 174 to operate and function in accordance with the job plan, as well as to adapt to changing conditions or unanticipated events that arise during the operation without the need for human intervention, in some examples. In examples, IC may also log runtime operational parameters in its memory. After the mission is completed and downhole tool 174 has either docked to docking station 186, been disassembled by robotic tool assembly 178, or else interfaced with well system 100 (e.g., referring to FIG. 1A, 1B) in some manner following the operation, IC may download the log to cither or both robotic tool assembly 178 and docking station 186 which may then convey it to surface 103, e.g., via telemetry mechanism 134.

During operations, a traction subsystem may provide propulsion to downhole tool 174 when downhole tool 174 is in, for example, a horizontal or deviated section of wellbore 122. Traction subsystem may also provide power for docking downhole tool 174 to docking station 186. In examples, traction subsystem may comprise motors, speed/position sensors, transmission, wheels, contact force adjustment system, drive electronics, and/or motor & traction controller. Where used, motor & traction controllers may communicate with an IC of downhole tool 174 and download run time commands. Based on these commands, motor & traction controller may provide the commutation signals for the drive electronics to run the motors at the desired operating conditions-torque/speed/power. Traction control subsystem may comprise wheel slip/slide detection & correction and contact force adjustment to achieve needed adhesion between wheel(s) and the casing. In some cases, the drive motors may be regenerative. If the fluid drag is pushing downhole tool 174 or if the gravitational forces are pulling downhole tool 174, then the drive motors may serve as generators and produce electrical power. This produced electrical power may be used to augment the stored energy on downhole tool 174, to recharge the secondary batteries, or may be used to estimate the health of downhole tool 174.

During operations, downhole tool 174 may utilize one or more intervention tools. The intervention tool may comprise an anchor to anchor the downhole tool 174 in wellbore 122, a linear or rotary actuator, a linear or rotary actuated accessory/accessories, and/or sensors for operation of the intervention tool. Intervention tools may each comprise drive electronics and/or motors to drive the actuators. Each intervention tool may be chosen based on the kind of intervention operation to be conducted in wellbore 122. Non-liming examples of intervention tools comprise a shifter, a miller, a bailer, a hone, and a rush. In some examples, intervention tools connected to downhole tool 174 may be able to carry parts, as may be needed, to replace worn out parts on completion equipment disposed within wellbore 122. Examples of such parts may be a power pack, pressure gages, etc. In another example, an intervention tool may utilize a pyrotechnic compositions such as Thermite to perform controlled ignition to melt down paraffin wax in the production flow path, for example. In other examples, downhole tool 174 may carry production logging tools to log pressure/temperature/flow rate etc. Downhole tool 174 may be deployed without intervention tools for collecting information from completion sensors or for pressure/temperature surveys of wellbore 122. In some examples, production logging tools may be connectable to downhole tool 174. In some examples, downhole tool 174 may comprise a permanent or a semi-permanent downhole tool to be disposed within wellbore 122. For example, downhole tool 174 may be disposed in wellbore 122 for a period of least 1 hour, at least 1 day, at least 2 days, at least 1 week, at least 2 weeks, at least 1 month, and at least 3 months, in some examples, before retrieval, such as when the operation is an ongoing logging operation. Thus, the various subassemblies of downhole tool 174 may comprise a plurality of wellbore operational equipment including, for example and without limitation, logging sensors such as electromagnetic sensors, pulsed neutron, or passive gamma ray sensors, acoustic sensors, fluid measurement devices and sampling capability. In some examples, surface conditions may provide triggers for logging or sampling with downhole tool 174.

downhole tool 174 may be tethered or untethered. Where used, a tether may extend along a substantial length of wellbore 122, such as between a docking station 186 to a most distal portion to be logged or an intervention operation performed. In such examples, a tether may provide a retractable force to be applied to downhole tool 174 should gravity not be adequate to retract a downhole tool to a desired location. A tether may also supply power or telemetry directly to downhole tool 174. Docking station 186 may pass energy from a wired means or from downhole power generation or stored energy from either downhole power generation or wired means. For instance, a larger battery bank, capacitor bank or electrochemical cell may be located in docking station 186. Thereby, low power from wiring may be stored for larger power boosts to downhole tool 174 via a tether. A tether may be released and retracted in order to keep the tether taut and may further provide means of measuring position within wellbore 122.

Accordingly, the present disclosure may provide methods and systems for building and deploying a downhole tool at the sea-floor. The methods and systems may include any of the various features disclosed herein, including one or more of the following statements.

Statement 1: A method comprising: assembling a downhole tool from a plurality of subassemblies with a robotic tool assembly disposed on a subsea tree at a sea-floor in a subsea environment; introducing the downhole tool into a wellbore; traversing the wellbore with the downhole tool to reach one or more target depths; and performing at least a wellbore operation with the downhole tool at the one or more target depths.

Statement 2: The method of statement 1, further comprising: retrieving the downhole tool from the wellbore after performing the wellbore operation; and disassembling the downhole tool with the robotic tool assembly after retrieving the downhole tool from the wellbore.

Statement 3: The method of statement 2, wherein the assembling and the disassembling is performed autonomously by the robotic tool assembly based on instructions specific for a type of the downhole tool.

Statement 4: The method of any of statements 1-3, wherein traversing the wellbore with the downhole tool comprises lowering the downhole tool to the one or more target depths using a wireline, wherein at least a portion of the wireline is initially housed within the robotic tool assembly or the subsea tree.

Statement 5: The method of any of statements 1-4, wherein the downhole tool is an untethered robot.

Statement 6: The method of any of statements 1-5, wherein the assembling is performed using one or more robotic arms disposed within the robotic tool assembly.

Statement 7: The method of any of statements 1-6, wherein the assembling comprises stacking two or more of the subassemblies together and raising the stacked subassemblies into a vertical lubricator.

Statement 8: The method of any of statements 1-7, wherein the assembling comprises: identifying and locating subassemblies of the robotic tool assembly; picking the identified subassemblies from respective storage locations of the robotic tool assembly; moving the picked subassemblies into an assembly space; and connecting the picked subassemblies together within the assembly space to form the downhole tool.

Statement 9: The method of any of statements 1-8, wherein two or more connections between different combinations of subassemblies of the downhole tool comprise a single connection-type.

Statement 10: The method of statement 9, wherein the single connection-type is a pressed-in or a spun-in connection.

Statement 11: The method of any of statements 1-10, further comprising transporting one or more carrier tubes containing one or more of the plurality of subassemblies using an underwater autonomous vehicle.

Statement 12: The method of any of statements 1-11, further comprising monitoring the downhole tool during the performing of the wellbore operation, wherein the method further comprises relaying instructions to the robotic tool assembly from a sea bed server to retract or recall the downhole tool.

Statement 13: The method of any of statements 1-12, further comprising removing one or more batteries from one or more of the subassemblies and placing the batteries in a charging station disposed at or within a housing of the robotic tool assembly.

Statement 14: The method of any of statements 1-13, wherein retrieving the downhole tool after performing the wellbore operation comprises modifying a buoyancy of the downhole tool by expelling fluid out from the downhole tool and/or deploying a sail or opening a chute of the downhole tool.

Statement 15: The method of any of statements 1-14, wherein the wellbore operation comprises at least one intervention operation selected from the group consisting of:

valve shifting, brushing, bailing, milling, routine pressure balancing, logging, and any combination thereof.

Statement 16: The method of any of statements 1-15, further comprising: downloading wellbore operation data gathered by the downhole tool during the wellbore operation to a memory device stored at the sea-floor; and conveying the downloaded data to a surface location.

Statement 17: A system comprising: a subsea tree disposed on a wellhead of a wellbore; a robotic tool assembly disposed at or on the subsea tree; and a plurality of storage locations for holding a plurality of subassemblies, wherein the robotic tool assembly is configured to assemble a downhole tool comprising the plurality of subassemblies.

Statement 18: The system of statement 17, further comprising: a well access; a vertical lubricator disposed above the wellhead; one or more valves for eliminating a pressure difference across the well access.

Statement 19: The system of statements 17 or 18, wherein at least one of the plurality of subassemblies comprises a buoyancy controller, a flow assisted conveyance module, energy storage, a telemetry module, a docking and release module, a sensors and navigation module, a central controller unit, a traction system module, an intervention tool module, and any combination thereof.

Statement 20: The system of any of statements 17-19, wherein the robotic tool assembly comprises a storage revolver configured to revolve the plurality of storage locations, the plurality of subassemblies, or both, about an assembly area of the robotic tool assembly.

Statement 21: A method comprising assembling a downhole tool from a plurality of subassemblies with a robotic tool assembly disposed on a subsea tree at a sea-floor in a subsea environment.

Statement 22: The method of statement 22, further comprising introducing the downhole tool into a wellbore.

Statement 23: The method of statement 22 or 23, further comprising traversing the wellbore with the downhole tool to reach one or more target depths.

Statement 24: The method of any of statements 21-23, further comprising performing at least a wellbore operation with the downhole tool at the one or more target depths.

Statement 25: The method of any of statements 21-24, further comprising retrieving the downhole tool from the wellbore after performing the wellbore operation.

Advantages of the present disclosure are various and may include, in some examples, the ability to autonomously perform wellbore interventions using downhole tools assembled at or near the sea-floor. This may simplify the ergonomics of wellbore operations by reducing or eliminating the need for extensive planning and personnel.

Although the present disclosure and its advantages have been described in detail, it should be understood that various changes, substitutions, and alterations may be made herein without departing from the spirit and scope of the disclosure as defined by the appended claims. The preceding description provides various embodiments of the systems and methods of use disclosed herein which may contain different method steps and alternative combinations of components. It should be understood that, although individual embodiments may be discussed herein, the present disclosure covers all combinations of the disclosed embodiments, including, without limitation, the different component combinations, method step combinations, and properties of the system. The term "include," and derivations thereof, mean "including, but not limited to." However, it should be understood that the systems and methods are described in terms of "including," "containing," or "including" various components or steps, the systems and methods can also "consist essentially of" or "consist of" the various components and steps. Moreover, the indefinite articles "a" or "an," as used in the claims, are defined herein to mean one or more than one of the element that it introduces. Furthermore, the word "may" is used throughout this application in a permissive sense (i.e., having the potential to, being able to), not in a mandatory sense (i.e., must). The term "coupled" means directly or indirectly connected. If there is any conflict in the usages of a word or term in this specification and one or more patent or other documents that may be incorporated herein by reference, the definitions that are consistent with this specification should be adopted for the purposes of understanding this invention.

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any comprised range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

Therefore, the present embodiments are well adapted to attain the ends and advantages mentioned as well as those that are inherent therein. The particular embodiments disclosed above are illustrative only, and may be modified and practiced in different but equivalent manners apparent to those skilled in the art having the benefit of the teachings herein. Although individual embodiments are discussed, the disclosure covers all combinations of all of the embodiments. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative embodiments disclosed above may be altered or modified and all such variations are considered within the scope and spirit of those embodiments. If there is any conflict in the usages of a word or term in this specification and one or more patent(s) or other documents that may be incorporated herein by reference, the definitions that are consistent with this specification should be adopted.

What is claimed is:

1. A method comprising:

assembling a downhole tool from a plurality of subassemblies with a robotic tool assembly disposed on a subsea tree at a sea-floor in a subsea environment;

introducing the downhole tool into a wellbore;

traversing the wellbore with the downhole tool to reach a target depth;

performing a wellbore operation with the downhole tool at the target depth;

removing a battery from a subassembly of the plurality of subassemblies; and placing the battery in a charging station disposed at or within a housing of the robotic tool assembly.

2. The method of claim 1, further comprising:

retrieving the downhole tool from the wellbore after performing the wellbore operation; and disassembling the downhole tool with the robotic tool assembly after retrieving the downhole tool from the wellbore.

3. The method of claim 2, wherein the assembling and the disassembling is performed autonomously by the robotic tool assembly based on instructions specific for a type of the downhole tool.

4. The method of claim 1, wherein traversing the wellbore with the downhole tool comprises lowering the downhole tool to the target depth using a wireline, wherein at least a portion of the wireline is initially housed within the robotic tool assembly or the subsea tree.

5. The method of claim 1, wherein the downhole tool is an untethered robot.

6. The method of claim 1, wherein assembling the downhole tool is performed using a robotic arm disposed within the robotic tool assembly.

7. The method of claim 1, wherein assembling the downhole tool comprises:

stacking two or more of the subassemblies together; and raising the subassemblies into a vertical lubricator.

8. The method of claim 1, wherein assembling the downhole comprises:

identifying and locating subassemblies of the robotic tool assembly;

picking the subassemblies from respective storage locations of the robotic tool assembly;

moving the subassemblies into an assembly space; and connecting the subassemblies together within the assembly space to form the downhole tool.

9. The method of claim 1, wherein two or more connections between different combinations of subassemblies of the downhole tool comprise a single connection-type.

10. The method of claim 9, wherein the single connection-type is a pressed-in or a spun-in connection.

11. The method of claim 1, further comprising:

transporting, using an underwater autonomous vehicle, a carrier tube containing a subassembly of the plurality of subassemblies.

12. The method of claim 1, wherein during the performing of the wellbore operation, the method further comprises:

monitoring the downhole tool; and relaying, from a sea bed server to the robotic tool assembly, instructions to retract or recall the downhole tool.

13. The method of claim 1, wherein the wellbore operation comprises:

an intervention operation selected from the group consisting of:

valve shifting, brushing, bailing, milling, routine pressure balancing, logging, and any combination thereof.

14. The method of claim 1, further comprising:

downloading wellbore operation data gathered by the downhole tool during the wellbore operation to a memory device stored at the sea-floor; and conveying the wellbore operation data to a surface location.

15. A method comprising:

assembling a downhole tool from a plurality of subassemblies with a robotic tool assembly disposed on a subsea tree at a sea-floor in a subsea environment;

introducing the downhole tool into a wellbore;

traversing the wellbore with the downhole tool to reach target depth; and performing a wellbore operation with the downhole tool at the target depth, wherein after performing the wellbore operation, the method further comprises:

retrieving the downhole tool, comprising:

modifying a buoyancy of the downhole tool by expelling fluid out from the downhole tool; and/or deploying a sail or opening a chute of the downhole tool.

16. A system comprising:

a subsea tree disposed on a wellhead of a wellbore;

a plurality of storage locations for holding a plurality of subassemblies, respectively; and a robotic tool assembly, disposed at or on the subsea tree, configured to:

assemble a downhole tool from the plurality of subassemblies;

introduce the downhole tool into the wellbore;

traverse the wellbore with the downhole tool to reach a target depth;

performing a wellbore operation with the downhole tool at the target depth;

removing a battery from a subassembly of the plurality of subassemblies; and placing the batteries in a charging station disposed at or within a housing of the robotic tool assembly.

17. The system of claim 16, further comprising:

a well access;

a vertical lubricator disposed above the wellhead; and a valve for eliminating a pressure difference across the well access.

18. The system of claim 16, wherein a subassembly of the plurality of subassemblies comprises a component selected from the group consisting of:

a buoyancy controller, a flow assisted conveyance module, energy storage, a telemetry module, a docking and release module, a sensors and navigation module, a central controller unit, a traction system module, an intervention tool module, and any combination thereof.

19. The system of claim 16, wherein the robotic tool assembly comprises;

a storage revolver configured to revolve the plurality of storage locations, the plurality of subassemblies, or both, about an assembly area of the robotic tool assembly.

20. A system comprising:

a subsea tree disposed on a wellhead of a wellbore;

a plurality of storage locations for holding a plurality of subassemblies, respectively; and a robotic tool assembly, disposed at or on the subsea tree, configured to:

assemble a downhole tool from the plurality of subassemblies; and retrieve the downhole tool from the wellbore after performing a wellbore operation, comprising:

modifying a buoyancy of the downhole tool by expelling fluid out from the downhole tool; and/or deploying a sail or opening a chute of the downhole tool.

* * * * *